US011535494B2

(12) United States Patent
Varon et al.

(10) Patent No.: US 11,535,494 B2
(45) Date of Patent: Dec. 27, 2022

(54) DOOR DETECTION SYSTEM AND METHOD

(71) Applicant: G.A.L. Manufacturing Company, LLC, Bronx, NY (US)

(72) Inventors: James Varon, River Vale, NJ (US); Walter Glaser, Bronx, NY (US)

(73) Assignee: G.A.L. Manufacturing Company, LLC, Bronx, NY (US)

( * ) Notice: Subject to any disclaimer, the term of this patent is extended or adjusted under 35 U.S.C. 154(b) by 447 days.

(21) Appl. No.: 16/625,353

(22) PCT Filed: Jun. 20, 2018

(86) PCT No.: PCT/US2018/038538
§ 371 (c)(1),
(2) Date: Dec. 20, 2019

(87) PCT Pub. No.: WO2018/237029
PCT Pub. Date: Dec. 27, 2018

(65) Prior Publication Data

US 2021/0047147 A1 Feb. 18, 2021

Related U.S. Application Data

(60) Provisional application No. 62/523,907, filed on Jun. 23, 2017.

(51) Int. Cl.
*B66B 13/22* (2006.01)
*B66B 13/04* (2006.01)
*B66B 13/08* (2006.01)

(52) U.S. Cl.
CPC ..... *B66B 13/22* (2013.01); *B66B 13/04* (2013.01); *B66B 13/08* (2013.01)

(58) Field of Classification Search
CPC ..... B66B 13/22; B66B 13/04; B66B 13/08; B66B 5/0031
See application file for complete search history.

(56) References Cited

U.S. PATENT DOCUMENTS 5,682,024 A 10/1997 Koopman, Jr. et al.
5,886,307 A 3/1999 Full et al.
(Continued)

FOREIGN PATENT DOCUMENTS

CN 1146969 A 4/1997
CN 1436148 A 8/2003
(Continued)

OTHER PUBLICATIONS

Chinese Search Report for Application No. 201880052147.1, dated Mar. 3, 2021, 8 pages.
(Continued)

*Primary Examiner* — Jeffrey Donels
(74) *Attorney, Agent, or Firm* — Lerner, David, Littenberg, Krumholz & Mentlik, LLP

(57) ABSTRACT

In an embodiment, a door detection system may include a transmitter, a receiver, a reflector, and one or more processors. The transmitter positioned on an elevator car door transmits a signal towards a reflector on a hoistway door and the reflector reflects the signal towards the receiver when the hoistway door is properly positioned with respect to the elevator door. The one or more processors determine whether the hoistway door is properly positioned with respect to the elevator car door based on the reflected signal received by the receiver. If the hoistway door is not properly positioned, the elevator car is prevented from moving. If the hoistway door is properly positioned, the elevator car is free to move.

13 Claims, 20 Drawing Sheets

(56) References Cited

U.S. PATENT DOCUMENTS

| | | | | |
|---|---|---|---|---|
| 6,167,991 | B1 | 1/2001 | Full et al. | |
| 6,382,362 | B1 * | 5/2002 | Kutz | B66B 13/22 187/280 |
| 9,751,727 | B1 * | 9/2017 | Novak | B66B 13/26 |
| 2004/0007429 | A1 | 1/2004 | Angst et al. | |
| 2004/0108171 | A1 | 6/2004 | De Coi | |
| 2005/0034931 | A1 | 2/2005 | Deplazes et al. | |
| 2005/0082121 | A1 | 4/2005 | Deplazes | |
| 2005/0103577 | A1 | 5/2005 | Warner | |
| 2008/0156591 | A1 | 7/2008 | Tracey | |
| 2014/0034426 | A1 | 2/2014 | Novak | |
| 2015/0284216 | A1 | 10/2015 | Sax et al. | |
| 2019/0010019 | A1 * | 1/2019 | Koushik | B66B 13/24 |

FOREIGN PATENT DOCUMENTS

| | | | |
|---|---|---|---|
| CN | 1608966 | A | 4/2005 |
| CN | 1642841 | A | 7/2005 |
| CN | 105035897 | A | 11/2015 |
| CN | 204938618 | U | 1/2016 |
| ID | 201702460 | | 8/2018 |
| WO | 2014067894 | A1 | 5/2014 |

OTHER PUBLICATIONS

International Search Report from PCT/US2018/038538, dated Sep. 19, 2018, pp. 1-2.

* cited by examiner

DOOR DETECTION SYSTEM AND METHOD

CROSS-REFERENCE TO RELATED APPLICATIONS

The present application is a national phase entry under 35 U.S.C. § 371 of International Application No. PCT/US2018/038538, filed Jun. 20, 2018, which claims the benefit of the filing date of U.S. Provisional Application No. 62/523,907, filed Jun. 23, 2017, entitled Elevator Door Detection System and Method, the disclosures of which are hereby incorporated herein by reference.

TECHNICAL FIELD

The present disclosure relates generally to elevator systems and, more particularly, to a door detection system that enhances safety.

BACKGROUND

Automatic elevator car systems, i.e., systems in which a car door automatically opens when the car reaches a floor and closes before the car leaves a floor, are well-known in the art. Additionally, such elevator systems may have a hoistway door that automatically opens and closes, or manually opens and closes.

The position of the car door and the hoistway door may dictate when a car hoisting apparatus moves the car to another floor. For example, when a hoistway door is closed, there is an operable switch (or switches), which, together with an operable switch (or switches) when the car door is closed, permits the car hoisting apparatus to move the car to another floor. When all switches have been operated to a predetermined switching state, such as closed, the car hoisting apparatus moves the car.

Elevator technicians and the like can interfere with the switches to leave the hoistway door open after the car has left the floor—creating a safety risk. For example, the hoistway door switch may be disabled or by-passed by a shunt to permit the car to continue to operate.

Similarly, if the car door switch (or gate switch) is disabled or by-passed, the car will move even if the car door is not closed. Permitting the car to be stopped and started by manipulation of car door switches also presents a safety hazard.

Thus, a need exists for additional means to detect the proper closure of the elevator car door and the hoistway door before operating the elevator car.

SUMMARY

In one aspect, the present disclosure relates to a system which provides additional safety means to combat tampering with normal operation of an elevator car.

A door detection system may include an elevator car door that moves towards and away from an elevator door frame, a hoistway door that moves towards and away from the elevator door frame, a transmitter-receiver positioned on the elevator car door with a first face configured to transmit a first signal and a second face configured to transmit and receive a second signal, a first receiver positioned on the elevator door frame configured to receive the first transmitted signal, and a reflector positioned on the hoistway door substantially opposite the second transmitting and receiving face when the elevator car door and the hoistway door are closed. The transmitter-receiver includes one or more processors configured to detect the reflected signal from the reflector, determine whether the hoistway door is properly positioned with respect to the elevator car door based on the detected signal, and send instructions to the elevator detection system to keep the elevator car stationary when the hoistway door is not properly positioned with respect to the elevator car door.

In one example, the first signal is an infrared light beam. In another example, the reflected signal transmitted from the reflector is more intense as compared to the reflected signal from the hoistway door. In yet another example, the first face is also configured to receive a reflected first signal. In a further example, the one or more processors determine the intensity of the detected reflected signal from the reflector and compare the detected signal to a preset threshold intensity to determine whether the elevator car door is closed.

In another example, the first signal is transmitted in a direction parallel with the elevator car. In yet another example, the second signal is transmitted in a direction perpendicular to the elevator car. In a further example, the first signal is transmitted in a direction parallel with the elevator car and the second signal is transmitted in a direction perpendicular to the elevator car. In still another example, the hoistway door is a swinging hoistway door that swings away from the elevator car door about a hinge.

Aspects of the disclosure provide for a system that also includes a first pair of contacts configured to indicate when an elevator car door of an elevator car is closed, and a second pair of contacts configured to indicate when a hoistway door is closed. This system also includes a transmitter positioned on the elevator car door configured to transmit a signal in a direction perpendicular to the elevator car door, a reflector positioned on the hoistway door substantially opposite the transmitter when the elevator car door and the hoistway door are closed, a receiver configured to receive the reflected signal from the reflector, and one or more processors. The one or more processors are configured to detect the reflected signal using the receiver, determine whether the hoistway door is properly positioned with respect to the elevator car door based on the detected signal, and send instructions to keep the elevator car stationary when the hoistway door is not properly positioned with respect to the elevator car door.

In one example, the elevator car door includes a first protrusion and the hoistway door includes a second protrusion, and the elevator door protrusion contacts the hoistway door protrusion to close the hoistway door. In another example, the hoistway door is a swinging hoistway door that swings away from the elevator car door about a hinge.

Aspects of the disclosure provide for a system that also includes one or more transmitters positioned on an elevator car door of an elevator car, one or more receivers positioned on the elevator car door and facing in the same direction as the one or more transmitters, a reflector positioned on a hoistway door substantially opposite to the one or more transmitters and the one or more receivers when the elevator car door and the hoistway door are closed, and one or more processors. The one or more transmitters face in a direction perpendicular to the elevator car door's surface and are configured to transmit a signal. The one or more processors are configured to detect the signal using the one or more receivers, determine whether the hoistway door is properly positioned with respect to the elevator car door based on the detected signal, and send instructions to an elevator system to keep the elevator car stationary when the hoistway door is not properly positioned with respect to the elevator car door.

Optionally, the system also includes one or more second transmitters positioned on the elevator car door of the elevator car, which face in a direction parallel to the elevator car door's surface and are configured to transmit a second signal. In this example, the system also includes one or more second receivers positioned on the elevator car door frame of the elevator car at least substantially opposite the one or more second transmitters. Also in this example, the one or more processors are configured to detect the second signal using the one or more first receivers and determine whether the elevator car door is closed based on the detected second signal.

Further aspects of the disclosure provide for a method. The method includes transmitting, by a transmitter controlled by one or more processors, a signal in a direction, the transmitter being positioned on an elevator car door of an elevator car and the direction being perpendicular to the elevator car door's surface; determining, by the one or more processors, whether the signal is detected at a receiver, the receiver being positioned on a hoistway door; determining, by the one or more processors, whether the hoistway door is properly positioned with respect to the elevator car door based on the detected signal; and sending, by the one or more processors, instructions to an elevator system to keep the elevator car stationary when the hoistway door is not properly positioned with respect to the elevator car door.

Still other aspects of the disclosure provide for another method. This method includes transmitting, by a first transmitter controlled by one or more processors, a first signal in a first direction, the first transmitter being positioned on an elevator car door of an elevator car; detecting, by the one or more processors, the first signal using a first receiver, the first receiver being positioned on an elevator car door frame of the elevator car; determining, by the one or more processors, whether the elevator car door is closed based on the detected first signal; transmitting, by a second transmitter controlled by the one or more processors, a second signal in a second direction, the second transmitter being positioned on the elevator car door; determining, by the one or more processors, whether the second signal is detected at a second receiver, the second receiver being positioned on a hoistway door; determining, by the one or more processors, whether the hoistway door is properly positioned with respect to the elevator car door based on the detected second signal; and sending, by the one or more processors, instructions to an elevator system to keep the elevator car stationary when either the elevator car door is not closed or the hoistway door is not properly positioned with respect to the elevator car door.

These and other objects, features and advantages of the present disclosure will become apparent in light of the following description of non-limiting embodiments, with reference to the accompanying drawings.

DETAILED DESCRIPTION

Figure 1A:
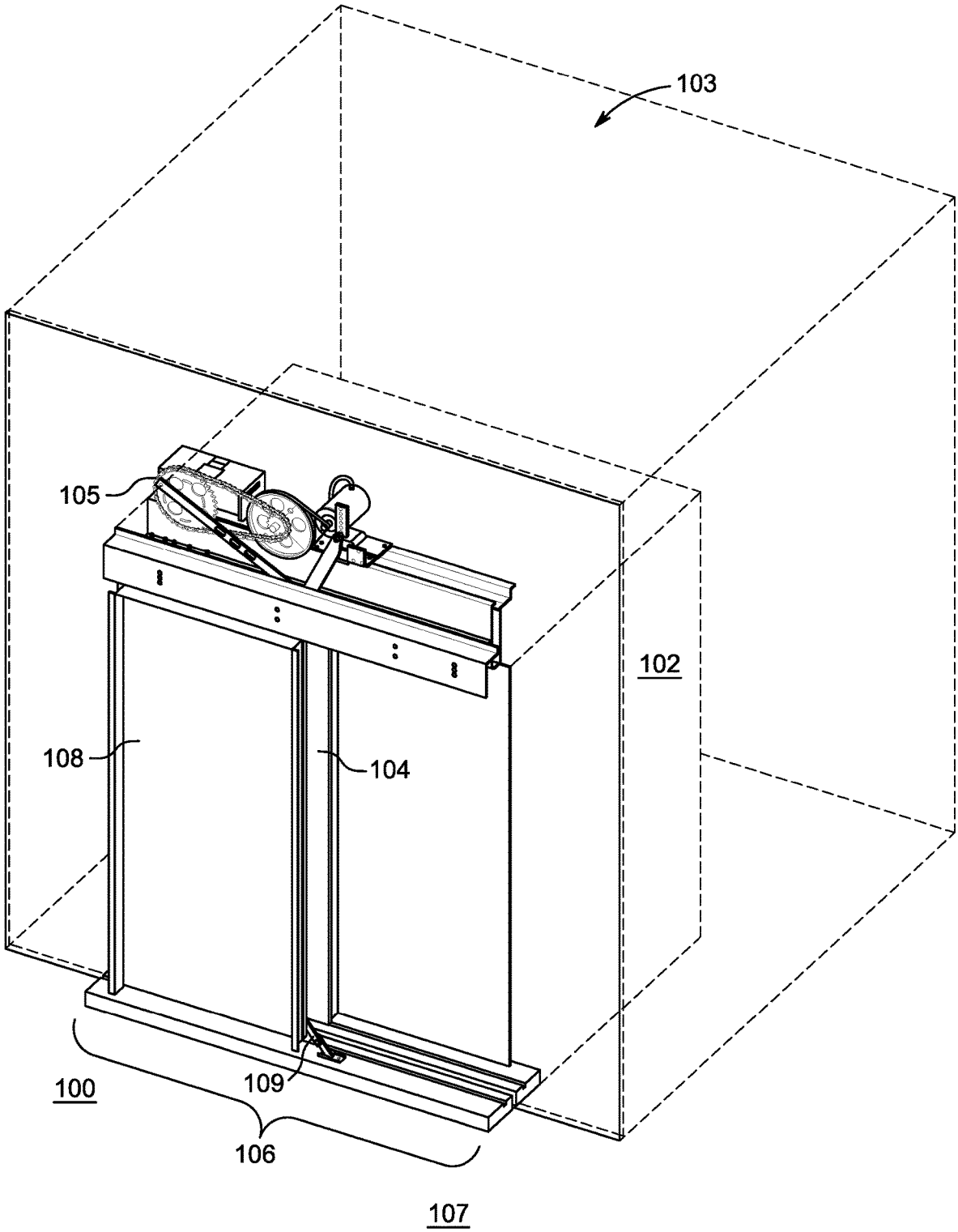
FIG. 1A is a perspective view of an elevator system in accordance with aspects of the disclosure.
Figure 1B:
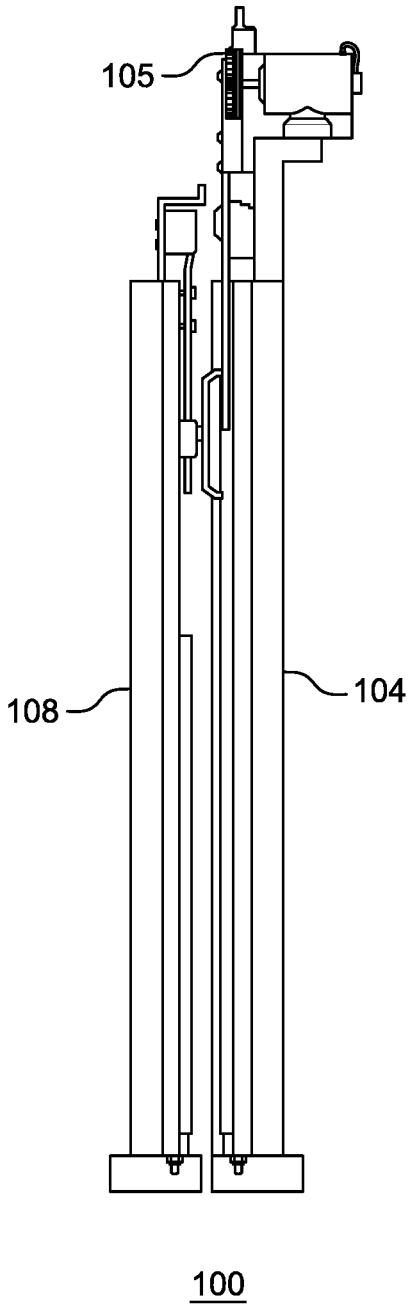
FIG. 1B is a side view of the elevator system of FIG. 1A in accordance with aspects of the disclosure.
Figure 1C:
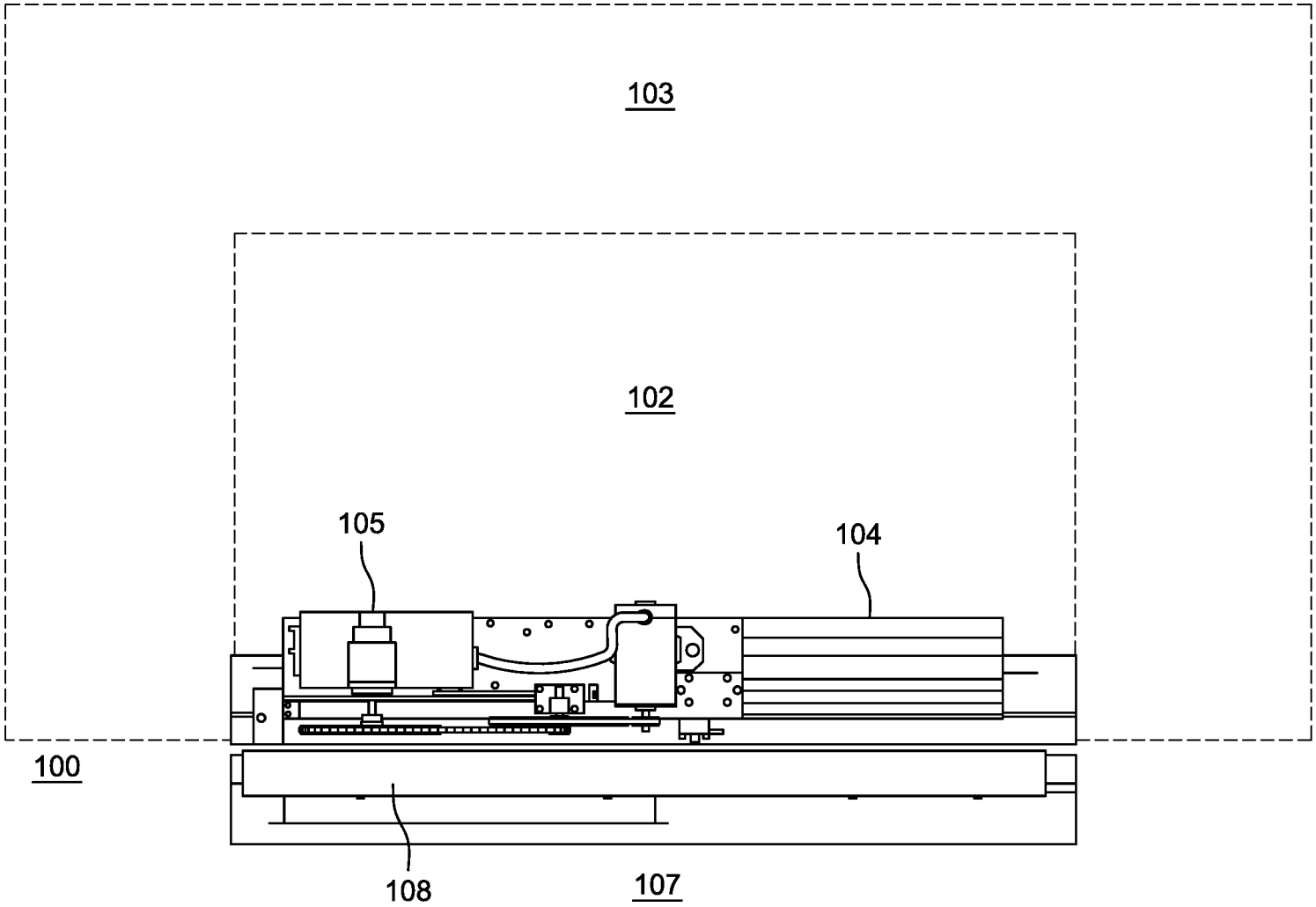
FIG. 1C is a top-down view of the elevator system of FIG. 1A in accordance with aspects of the disclosure.
Figure 1E:
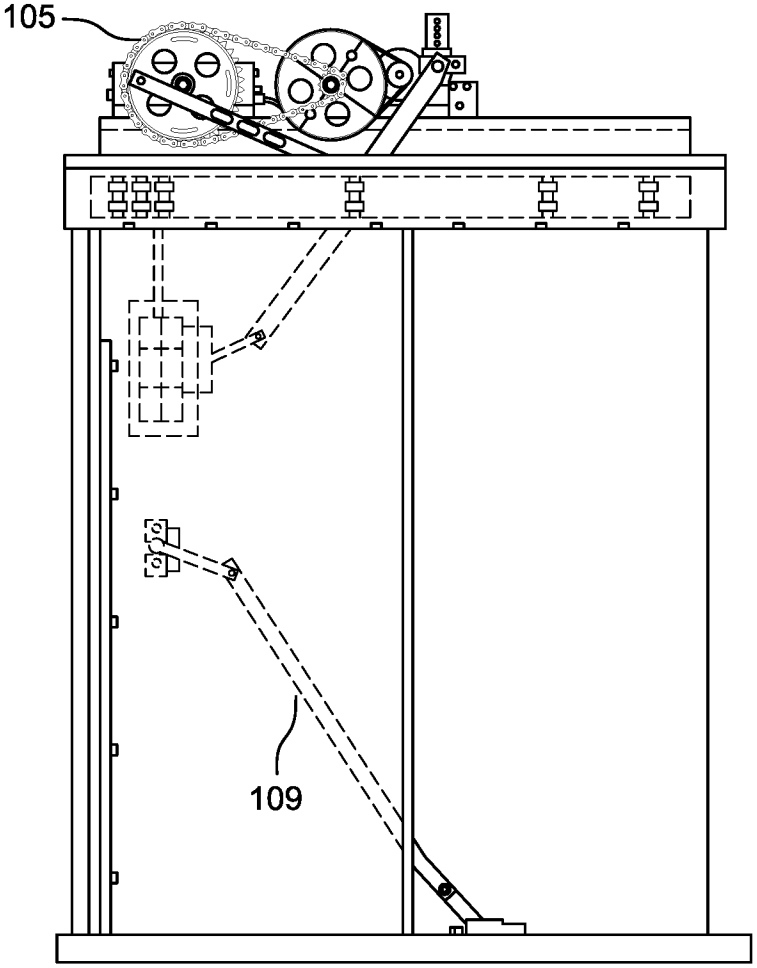
FIG. 1E is a front view of the elevator system of FIG. 1A with the hoistway door hidden for clarity in accordance with aspects of the disclosure.
Figure 1D:
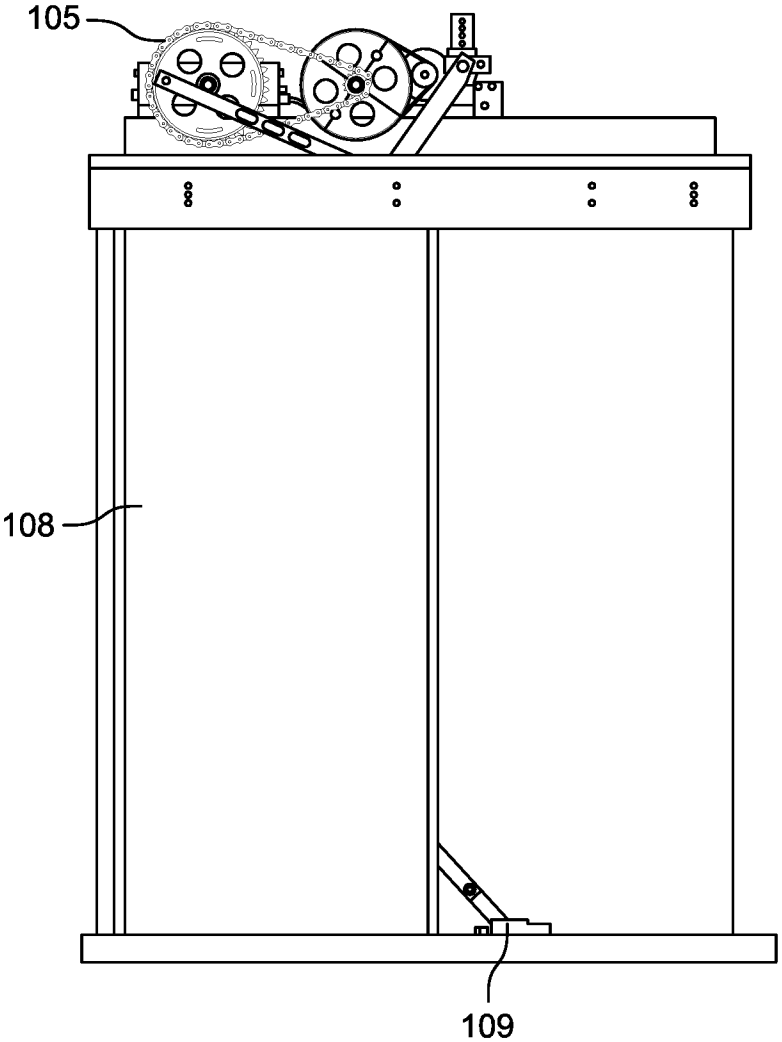
FIG. 1D is a front view of the elevator system of FIG. 1A with a hoistway door in a closed position in accordance with aspects of the disclosure.

Referring to FIGS. 1A-1E, an elevator system 100 includes an elevator car 102 situated within a hoistway shaft 103. The elevator car 102 may have a sliding elevator car door 104 that is controlled by arm mechanism 105. The elevator car 102 may be configured to align with an opening 106 of the hoistway shaft 103 at a floor 107 of a building. When aligned with the opening 106, the sliding elevator car door 104 is parallel to a hoistway door 108. Hoistway door 108 may be a sliding door controlled by arm mechanism 109. A clearer view of the arm mechanism 109 is shown FIG. 1E, where the hoistway door 108 is hidden.

Figure 1F:
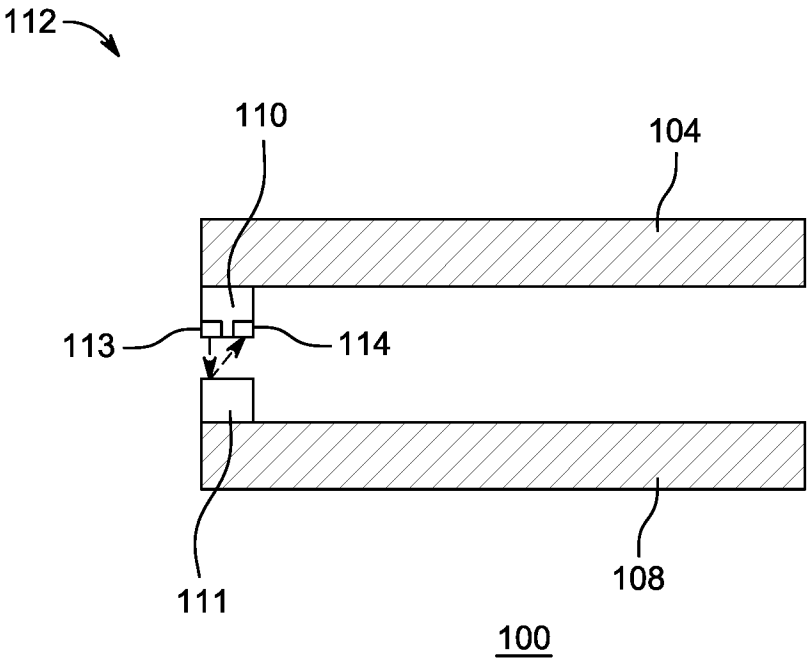
FIG. 1F is a top-down view of a detection system in accordance with aspects of the disclosure.

Referring to FIG. 1F, generally, a transmitter-receiver 110 and a reflector 111 constitute a door detection system 112. The transmitter-receiver 110 and reflector 111 may be added onto an existing elevator system or manufactured as part of a new elevator system. The transmitter-receiver 110 is positioned on the sliding elevator car door 104 while the reflector 111 is positioned on the hoistway door 108 facing the transmitter-receiver 110. When positioned directly across from one another, the transmitter-receiver 110 may be configured to transmit a signal in the direction of the reflector 111 and detect a signal from the reflector 111, which may be configured to reflect the signal transmitted from the transmitter part of the transmitter-receiver 110 towards the receiver part of the transmitter-receiver 110. For example, in some embodiments, the transmitter-receiver 110 transmits a signal in the direction of the reflector 111 from a light emitting diode (LED) 113 and receives the reflected signal from via an optical sensor 114. In some embodiments, the distance between the LED 113 and the optical sensor 114 may be between 0.1 to 2 inches, although other distances are also contemplated within the scope of the present disclosure. In some embodiments, the angle of incidence of the reflected signal is between 0° and 90°. In some embodiments the angle of incidence of the reflected signal is between 0° and 10°. In some embodiments the angle of incidence is 0°.

In some embodiments, the transmitter-receiver 110 can utilize near field communication (NFC), Bluetooth®, radio-frequency identification (RFID), or any combination thereof to transmit to, and/or receive signals from, the reflector 111. In embodiments, the reflector 111 can be a passive RFID tag or a barcode. In embodiments, the reflector 111 can be an active RFID tag with a local power source (such as a battery) powering the RFID tag.

Figure 1G:
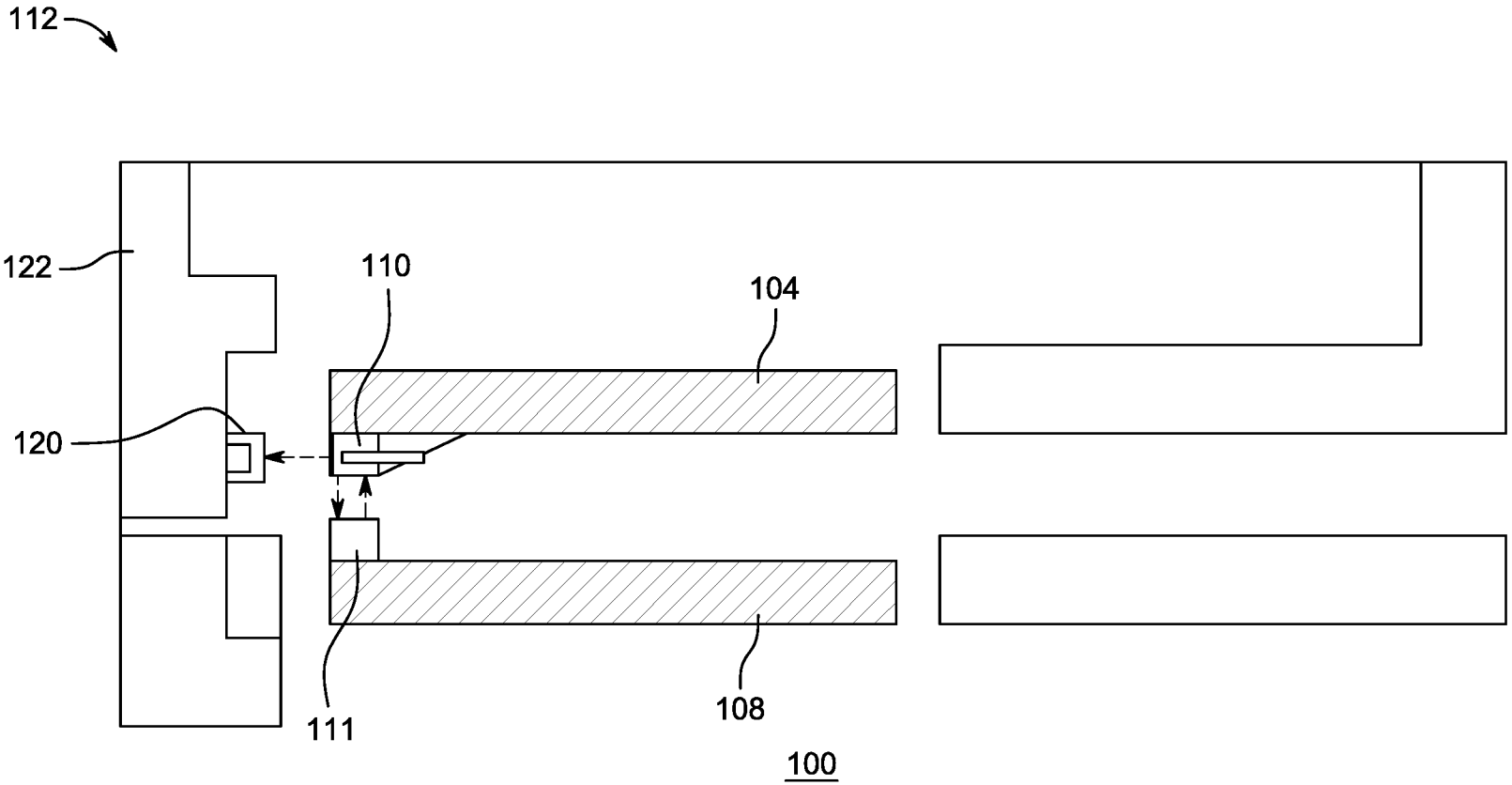
FIG. 1G is a top-down view of the elevator system of FIG. 1A including another detection system in accordance with aspects of the disclosure.

Referring to FIG. 1G, a door detection system 112 may also include a first receiver 120. The first receiver 120 may be positioned on an elevator door frame 122 facing the transmitter-receiver 110 and configured to receive and detect transmitted signals from the transmitter part of the transmitter-receiver 110.

In some embodiments, the transmitter part of the transmitter-receiver 110 may include a light curtain transmitter positioned along the edge of the elevator car door 104, pointed towards the elevator door frame 122, and configured to transmit a signal to the first receiver 120. In such embodiments, the first receiver 120 may be a light curtain receiver affixed to the elevator door frame 122, pointed towards the transmitter-receiver 110, and aligned with the light curtain transmitter.

When the transmitter-receiver 110 is properly aligned with the reflector 111 and the first receiver 120, the elevator door detection system 112 can detect and determine, using one or more computing devices, that the elevator car door 104 and hoistway door 108 are both properly closed. Similarly, if the transmitter-receiver 110 is not properly aligned with the first receiver 120 and the reflector 111, the elevator door detection system 112 can detect and determine, using the one or more computing devices, that either the elevator car door 104 or the hoistway door 108, or both, are not properly closed.

As further described herein, the transmitter-receiver 110, reflector 111 and first receiver 120 determine whether (1) the elevator car door 104 is closed and (2) whether the hoistway door 108 is properly positioned in a closed state when the elevator car door 104 is closed. If one or both of (1) and (2) are determined not to be true, then the elevator door detection system may prevent the elevator car 102 from moving until both (1) and (2) are determined to be true.

Figure 2A:
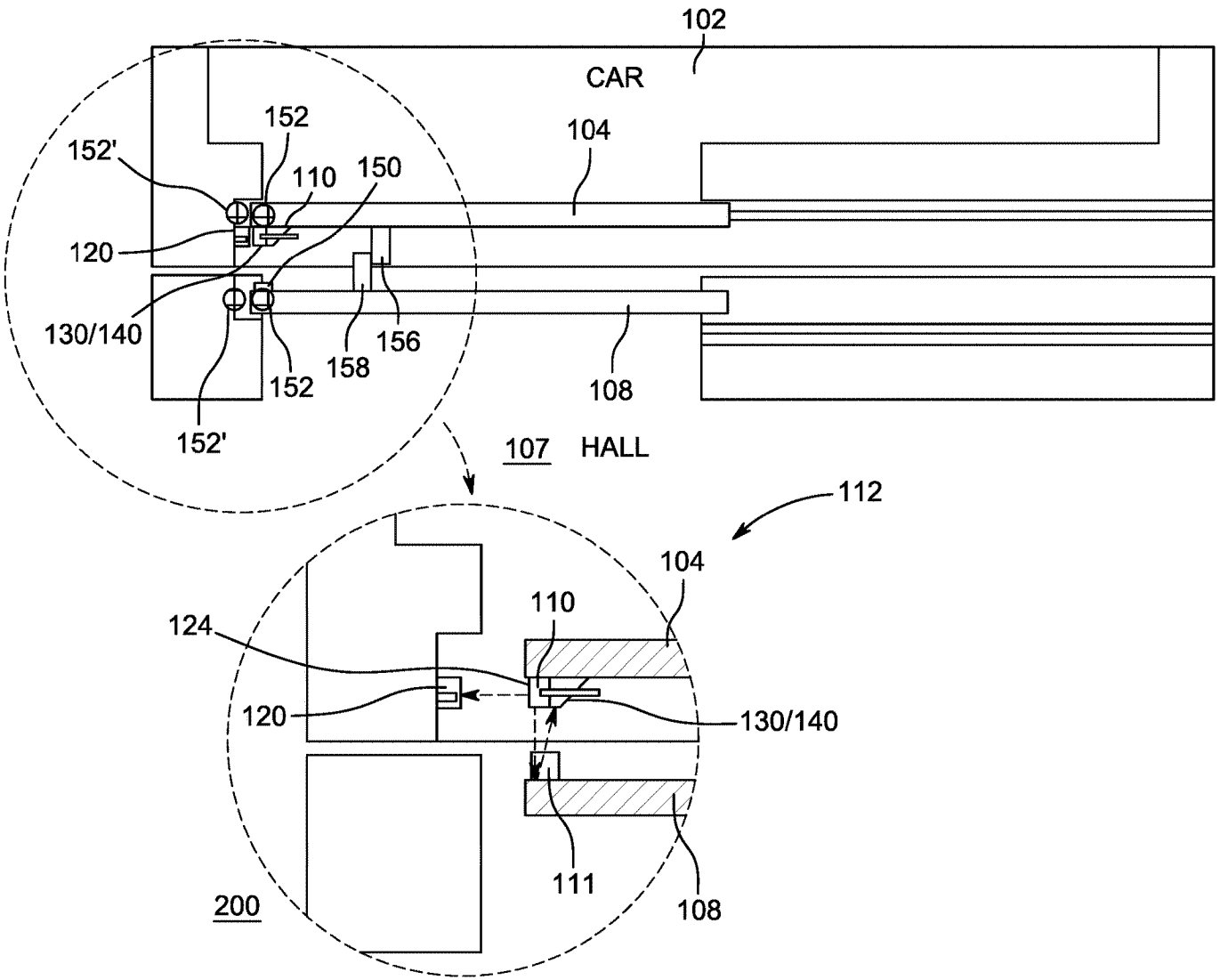
FIG. 2A is a top-down view of an elevator system in accordance with aspects of the disclosure including a close-up partial view of another detection system in accordance with aspects of the disclosure.

As shown in FIG. 2A, the elevator system 200 is configured to detect whether elevator car door 104 and hoistway door 108 are closed. In some embodiments, the elevator car door 104 and the hoistway door 108 may include contacts 152 and protrusions 156, 158 that aid in ensuring that both doors are closed before the elevator car 102 is operated. For example, with respect to the elevator car door 104, a contact 152 at the edge of the car door 104 can touch a corresponding contact 152' positioned in the elevator door frame 122 when the car door 104 is closed. A similar contact and door frame configuration may also be present with regards to the hoistway door 108. Protrusion 156, positioned on the outer surface of elevator car door 104, may be configured to contact protrusion 158, positioned on the hoistway door 108 opposite the elevator car door 104. When the elevator car door 104 is aligned with the hoistway door 108, the protrusions 156 and 158 may be in contact. As shown in FIG. 2A, the protrusion 158 may be positioned closer to the outer edge of the hoistway door 108 than protrusion 156 to the outer edge of the elevator car door 104. In addition, the right surface of the protrusion 158 may be in contact with the left surface of the protrusion 156 when both the elevator car door 104 and the hoistway door 108 are closed. In such embodiments, as the elevator car door 104 moves to a closed position, the car door protrusion 156 may push on the hoistway door protrusion 158 to push the hoistway door 108 into a closed position. Alternatively, the hoistway door 108 may move to a closed position without the assistance of the car door protrusion 156.

Still referring to FIG. 2A, in some embodiments, one or more transmitter-receivers 110 may be positioned along an edge of the elevator car door 104, such as within one or two inches from the edge of the elevator car door 104. The one or more transmitters-receivers 110 may have a first transmitting face 124 configured to transmit in a direction parallel to the elevator car door 104. One or more additional receivers 120 may be positioned on the inside of the elevator door frame 122 facing the first transmitting face 124. The one or more transmitters-receivers 110 may be configured to transmit a signal from the first transmitting face 124 towards the one or more receivers 120 configured to detect the transmitted signal. In some embodiments, the signal may be infrared light or other type of signal that may be reflected by a physical object. In some embodiments, the first transmitting face 124 of the one or more transmitters-receivers 110 may be a light curtain transmitter that emits signals along a plane, and the one or more first receivers 120 may be a light curtain receiver, such as described in U.S. Pat. No. 6,167,991 to Full et al. incorporated by reference herein.

The door detection system 112 may also include a transmitter-receiver 110 having a second transmitting face 130 and a second receiver 140 and one or more reflectors 111 positioned on the hoistway door 108 opposite the second transmitting face 130. The second transmitting face 130 of the transmitter-receiver 110 may be configured to transmit a signal in a direction perpendicular to the elevator car door 104. In some embodiments, the second receiver 140 is adjacent to or on the second transmitting face 130. When the elevator car door 104 and the hoistway door 108 are both closed, such that the reflector 111 is opposite the second transmitting face 130, the second transmitting face 130 may be configured to transmit a signal towards the reflector 111, positioned on hoistway door 108. The reflector 111 may be configured to reflect a signal transmitted from the second transmitting face 130, and the second receiver 140 may be configured to receive the reflected signal when the reflector 111 is opposite the second transmitting face 130. The signal may be any type of signal that may be reflected by a physical object, for example, infrared light.

Still referring to FIG. 2A, the elevator car door 104 and the hoistway door 108 may be configured to move between a closed position and an open position along respective tracks. As depicted in FIG. 2A, when both the elevator car door 104 and the hoistway door 108 are in the closed position, the first transmitting face 124 and the first receiver 120 may be in contact or nearly in contact, such as within an inch or two apart. In addition, the reflector 111 may be aligned with the second transmitting face 130 and the second receiver 140. In this closed position, the signal received at the first receiver 120 from the transmitter-receiver 110 may be at or above a first threshold intensity. Similarly, the reflected signal received at the second receiver 140 from the second transmitters 130 may be at or above a second threshold intensity. The first threshold intensity and the second threshold intensity values may be predetermined or pre-programmed in various processors and memory as described herein.

Figure 2B:
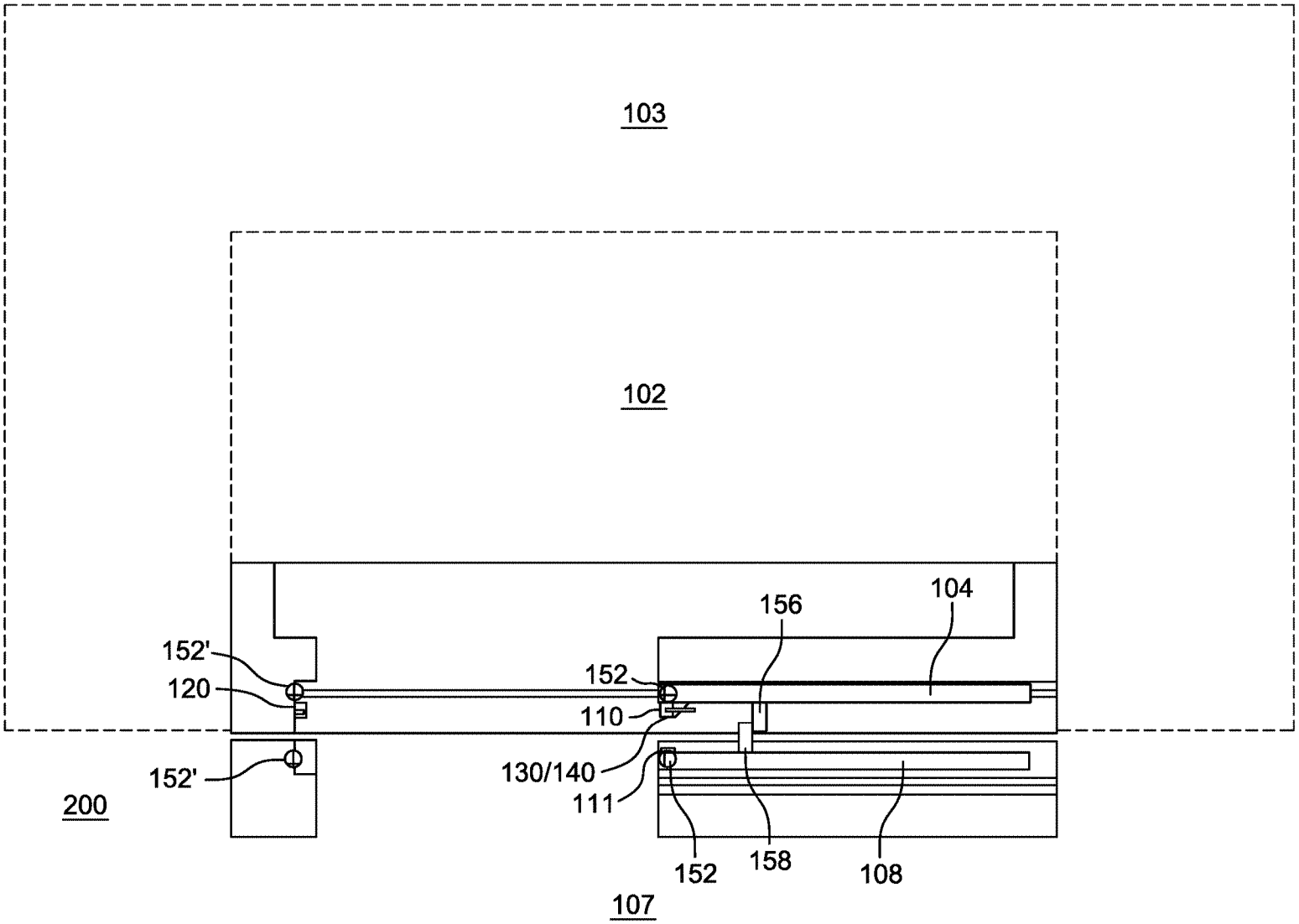
FIG. 2B is a top-down view of the elevator system of FIG. 2A in accordance with aspects of the disclosure.

Referring to FIG. 2B, when both the elevator car door 104 and the hoistway door 108 are in the open position, the transmitter-receiver 110 and the first receiver 120 may be a door's width apart. In addition, the reflector 111 may remain aligned with the second transmitting face 130 and the second receiver 140. In this open position, the signal received at the first receiver 120 from the transmitter-receiver 110 may be below the first threshold intensity, but the reflected signal received at the second receiver 140 from the second transmitting face 130 may be at or above the second threshold intensity. In some embodiments, the elevator car door 104 and the hoistway door 108 may slide between the closed position and the open position in tandem, such that the reflector 111 and the second transmitting face 130 are kept aligned when the elevator car door 104 and the hoistway door 108 are opening or closing.

Figure 2C:
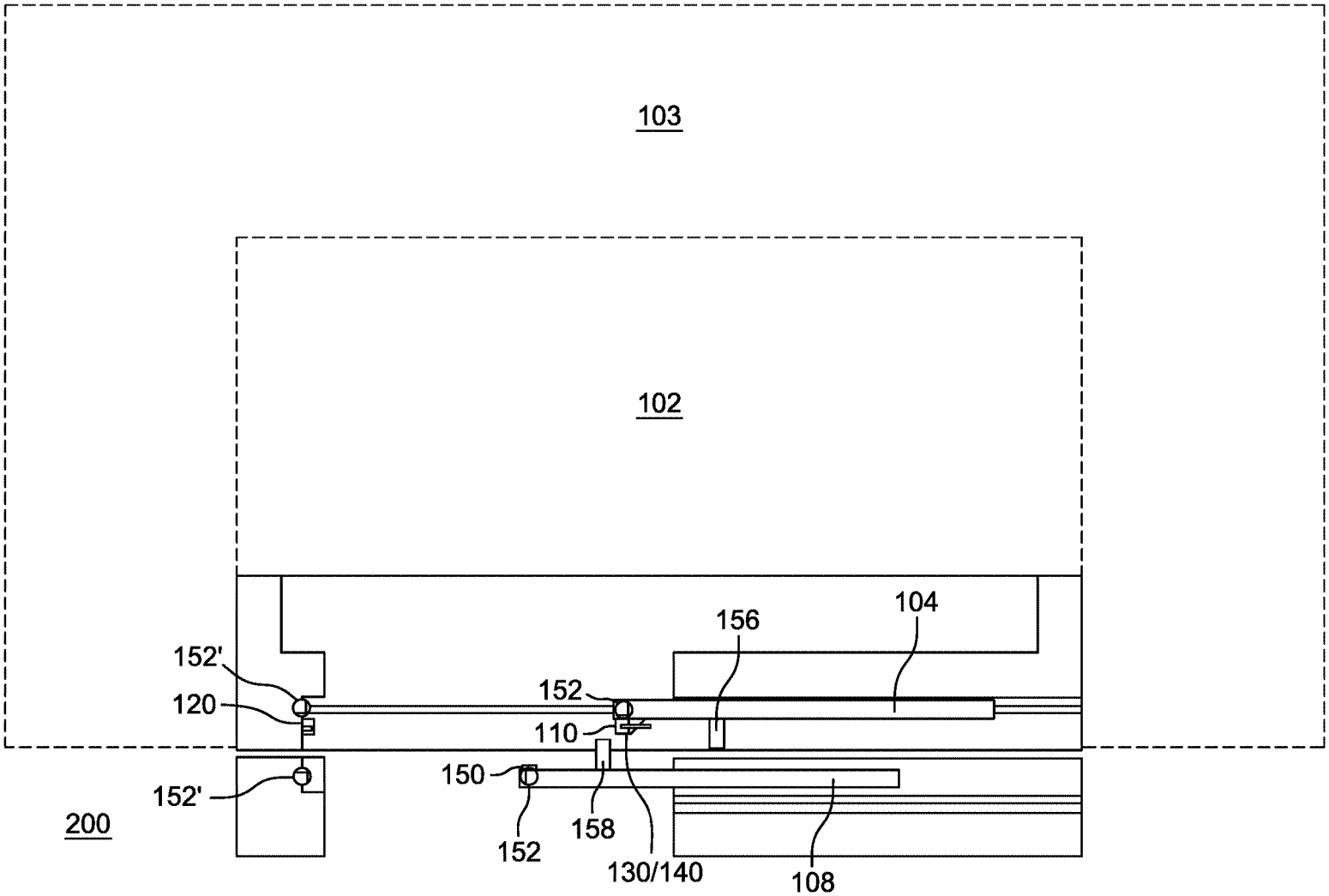
FIG. 2C is a top-down view of the elevator system of FIG. 2A in accordance with aspects of the disclosure.
Figure 2D:
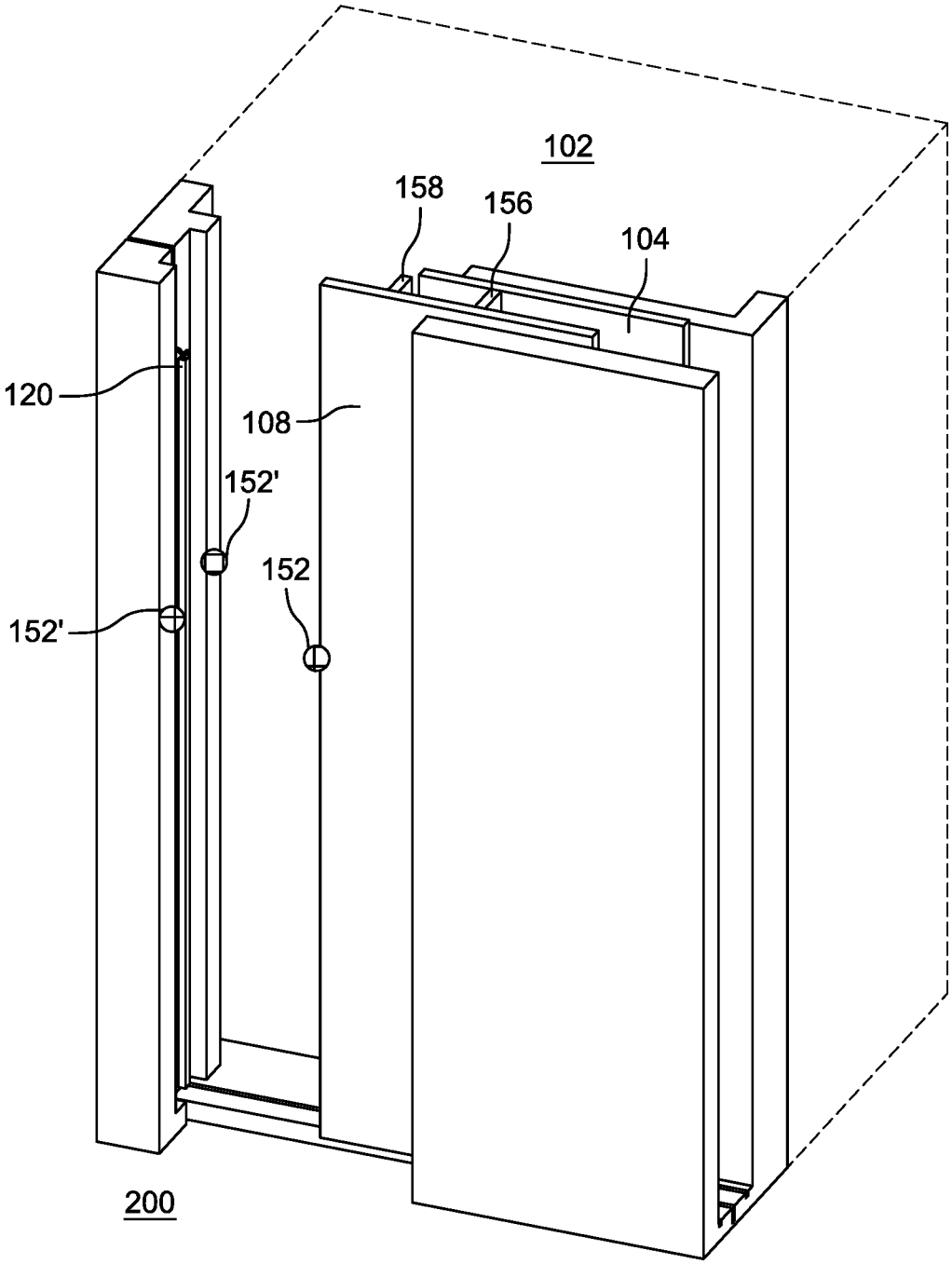
FIG. 2D is a perspective view of the elevator system of FIG. 2A in accordance with aspects of the disclosure.
Figure 2E:
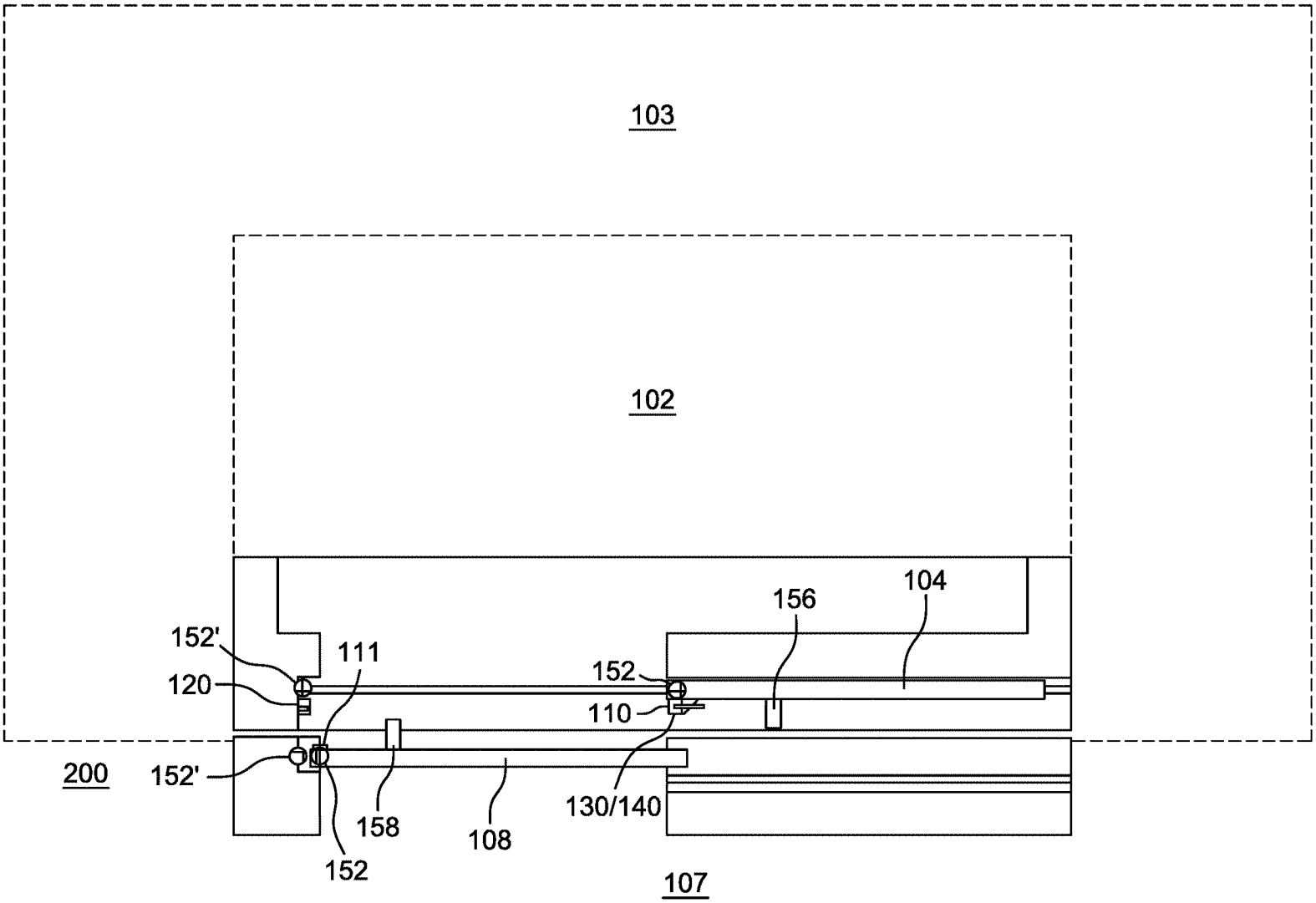
FIG. 2E is another top-down view of the elevator system of FIG. 2A in accordance with aspects of the disclosure.

When the elevator car door 104 and the hoistway door 108 are not in sync while stationary or moving, as shown in FIGS. 2C, 2D, and 2E, the reflector 111 may not be aligned respectively with the second transmitters 130 and the second receiver 140. Because the elevator car door 104 and the hoistway door 108 are not in sync, one door may reach a closed position and/or an open position before the other door. In the example shown in FIG. 2E, the hoistway door 108 may be in the closed position while the elevator car door 104 is in the open position. In these situations, the reflected signal received at the second receiver 140, from the one or more second transmitting faces 130, may be below the second threshold intensity. In some embodiments of the above described situations of FIGS. 2C, 2D, and 2E, no signal transmitted from the second transmitters 130 is reflected to the second receiver 140.

Figure 3A:
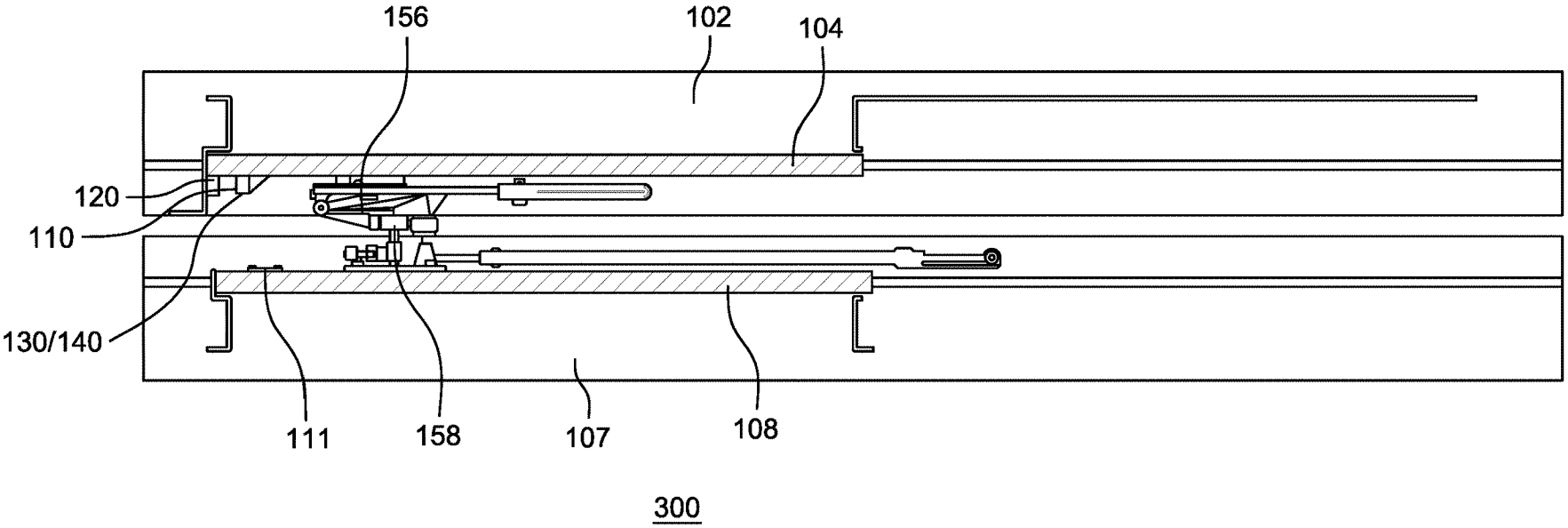
FIG. 3A is a top-down view of another elevator system in accordance with aspects of the disclosure with a detection system in accordance with aspects of the disclosure.
Figure 3B:
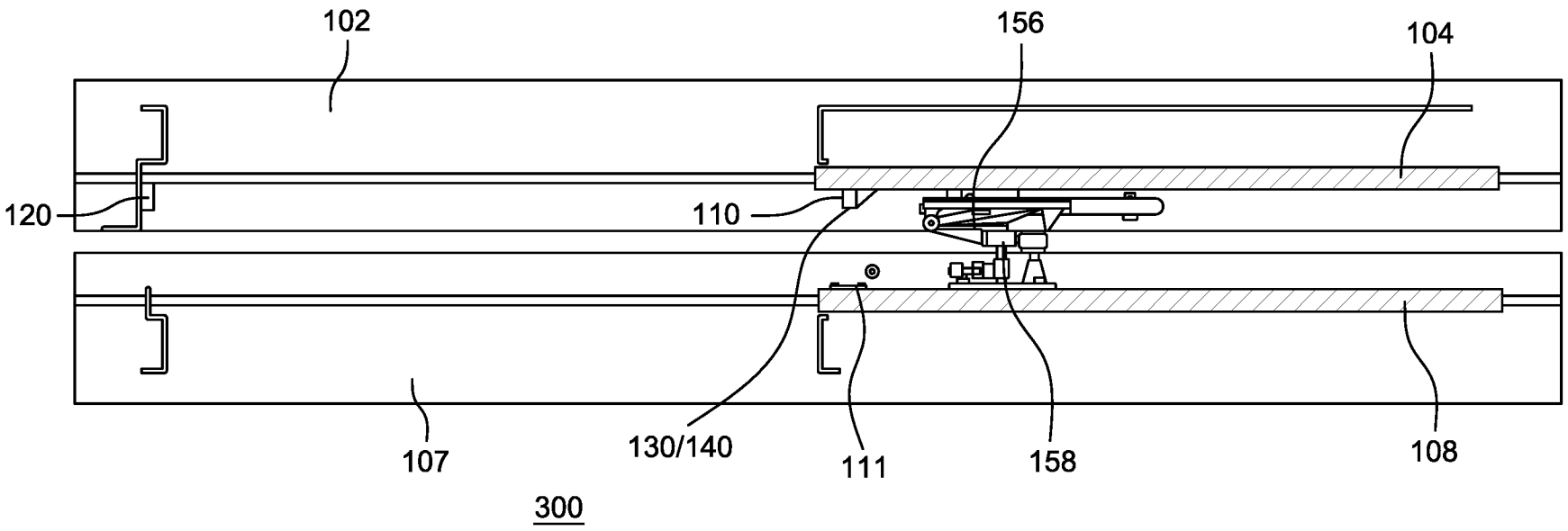
FIG. 3B is a top-down view of the elevator system and detection system of FIG. 3A in accordance with aspects of the disclosure.

Referring to FIGS. 3A-3D, elevator system 300 includes different configurations for protrusions 156 and 158. The elevator system 300 may also include transmitter-receiver 110, reflector 111, and first receiver 120 as described above in relation to elevator system 100. As shown in FIG. 3A, protrusions 156 and 158 may be configured such that protrusion 156 may be positioned closer to the outer edge of the elevator car door 104 than protrusion 158 is to the outer edge of the hoistway door 108. In addition, the right surface of the protrusion 156 may be in contact with the left surface of the protrusion 158 when both the elevator car door 104 and the hoistway door 108 are closed. As such, the protrusion 158 of hoistway door 108 may push on protrusion 156 of elevator car door 104 to push the elevator car door 108 into a closed position as the hoistway door 104 is closing, if the elevator car door 104 does not move to a closed position on its own accord.

Figure 3C:
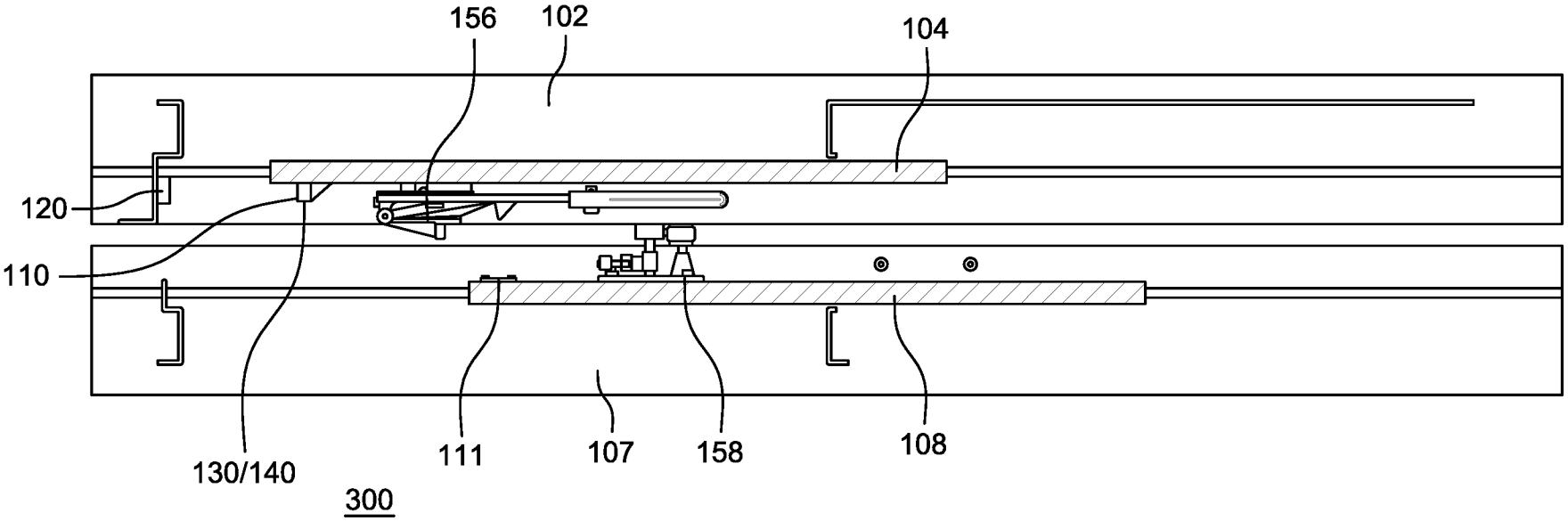
FIG. 3C is yet another top-down view of the elevator system and detection system of FIG. 3A in accordance with aspects of the disclosure.
Figure 3D:
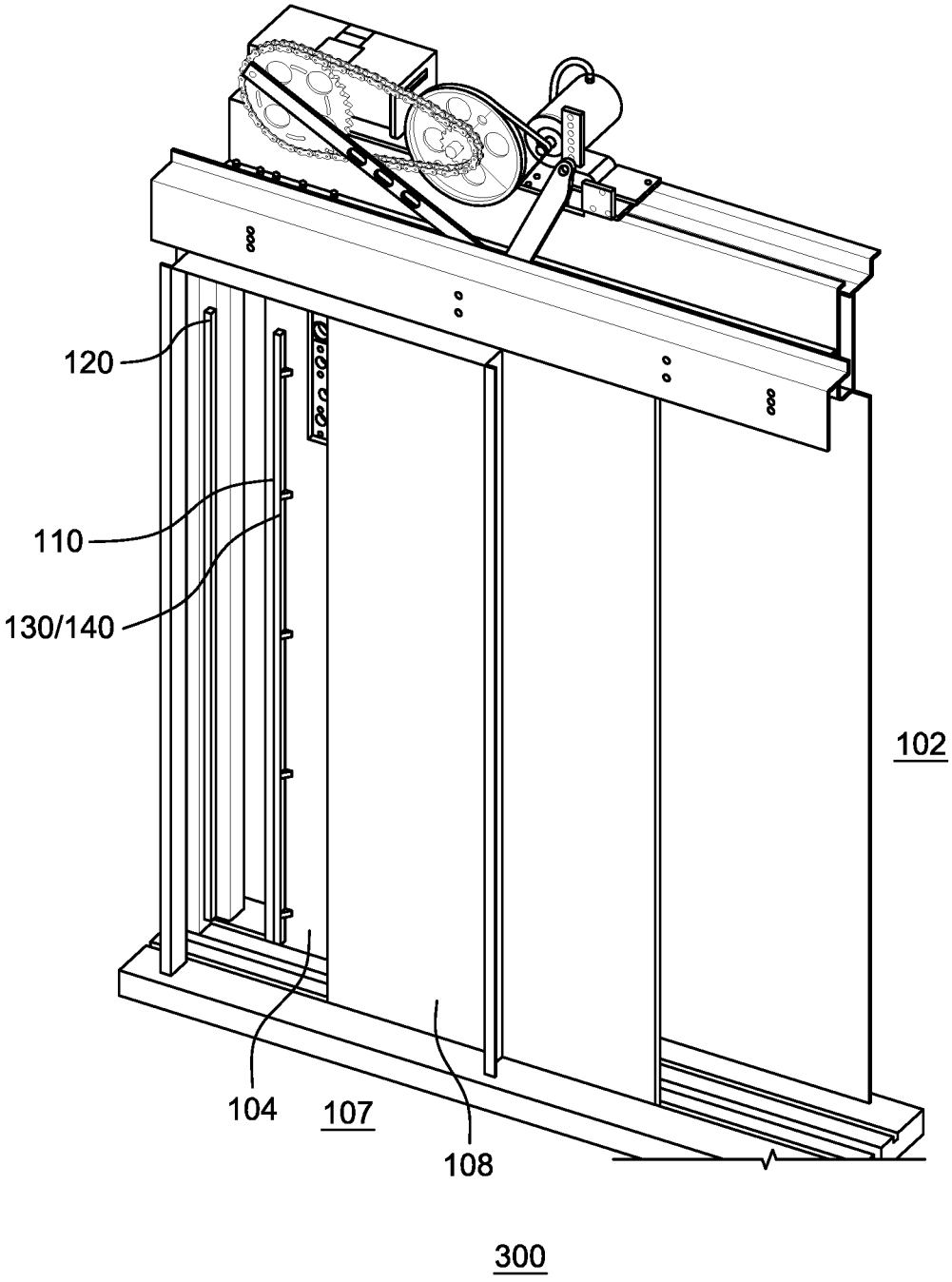
FIG. 3D is a perspective view of the elevator system and detection system of FIG. 3A in accordance with aspects of the disclosure.

As shown in FIGS. 3C and 3D, in elevator system 300, when the elevator car door 104 and the hoistway door 108 are not in sync, the reflector 111 may not be aligned with the second transmitting face 130 and second receiver 140. In such embodiments, the elevator car door 104 may be more closed than the hoistway door 108. When the elevator car door 104 and the hoistway door 108 are not in sync, one door may reach a closed position and/or an open position before the other door does. In these situations, the reflected signal received at the second receiver 140 may be below the second threshold intensity. In some embodiments of the above described situations of FIGS. 3C and 3D, no signal transmitted from the second transmitting face 130 is received at the second receiver 140.

Figure 4:
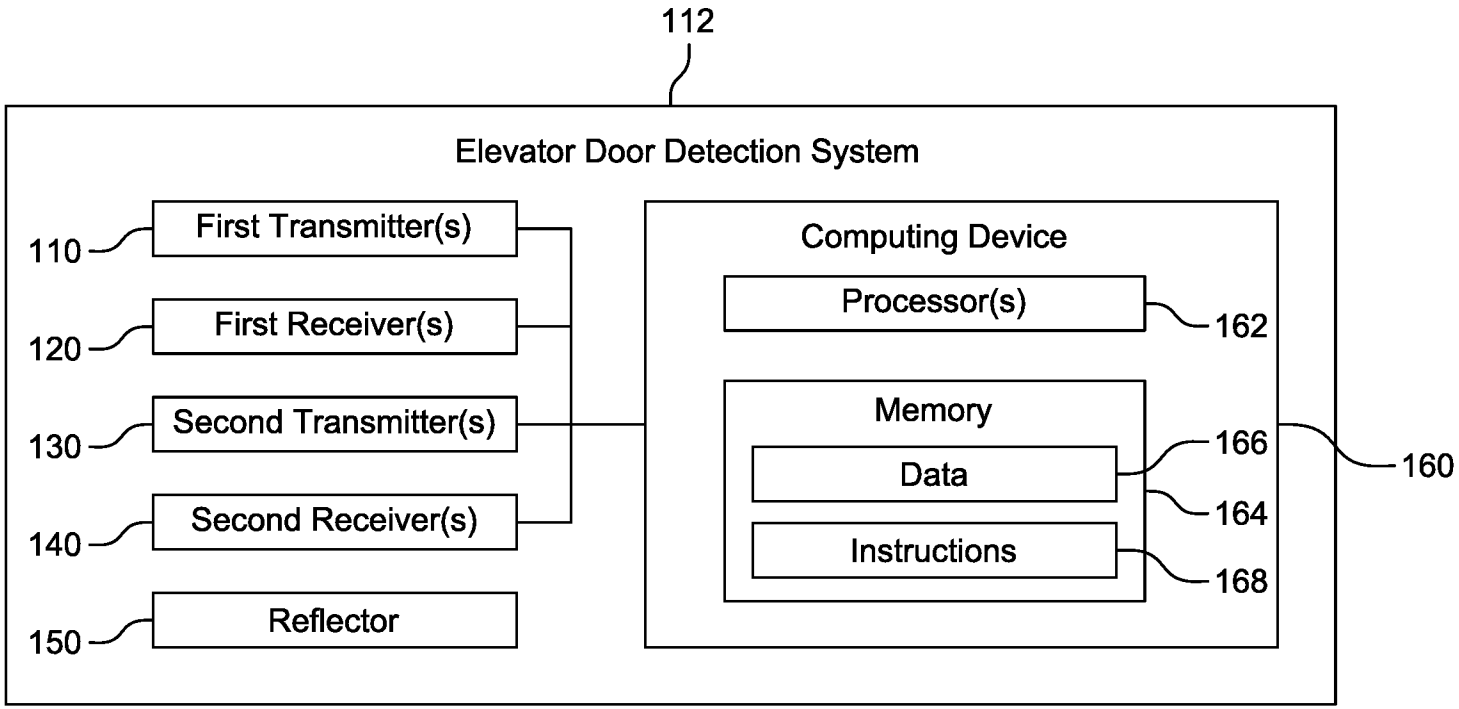
FIG. 4 is a functional diagram of the elevator system of FIG. 2A or FIG. 3A in accordance with aspects of the disclosure.

Referring to FIG. 4, the door detection system 112 may also include one or more computing devices 160. The one or more computing devices may be integrated into the transmitter-receiver 110 or be a separate computing module. The one or more computing devices 160 may comprise one or more processors 162 and a memory 164. The one or more processors 162 may be any conventional processors, such as commercially available CPUs. Alternatively, the one or more processors may be a dedicated device such as an application specific integrated circuit (ASIC) or other hardware-based processor, such as a field programmable gate array (FPGA). Although FIG. 4 functionally illustrates the one or more processors 162 and memory 164 as being within the same block, it will be understood that the one or more processors 162 and memory 164 may actually comprise multiple processors and memories that may or may not be stored within the same physical housing. Accordingly, references to a processor or computer will be understood to include references to a collection of processors or computers or memories that may or may not operate in parallel.

Memory 164 stores information accessible by the one or more processors 162, including data 166 and instructions 168 that may be executed by the one or more processors 210. The memory 164 may be of any type capable of storing information accessible by the processor, including a computer-readable medium such as a hard-drive, memory card, ROM, RAM, DVD or other optical disks, as well as other write-capable and read-only memories. The system and method may include different combinations of the foregoing, whereby different portions of the instructions and data are stored on different types of media.

Data 166 may be retrieved, stored or modified by the one or more processors 162 in accordance with the instructions 168. For instance, although the system and method is not limited by any particular data structure, the data 166 may be stored in computer registers, in a relational database as a table having a plurality of different fields and records, XML documents or flat files. The data 166 may also be formatted in any computer-readable format such as, but not limited to, binary values or Unicode. By further way of example only, image data may be stored as bitmaps comprised of grids of pixels that are stored in accordance with formats that are compressed or uncompressed, lossless (e.g., BMP) or lossy (e.g., JPEG), and bitmap or vector-based (e.g., SVG), as well as computer instructions for drawing graphics. The data 166 may comprise any information sufficient to identify the relevant information, such as numbers, descriptive text, proprietary codes, references to data stored in other areas of the same memory or different memories (including other network locations) or information that is used by a function to calculate the relevant data.

Instructions 168 may be any set of instructions to be executed directly (such as machine code) or indirectly (such as scripts) by the one or more processors 162. For example, the instructions 166 may cause the one or more processors 162 to transmit a signal via the one or more first transmitters 110 and/or the one or more second transmitters 130, to detect and process a signal received at the one or more first receivers 120 and/or the one or more second receivers 140, or to perform another step. The instructions 168 may be stored as computer code on the computer-readable medium. In that regard, the terms "instructions" and "programs" may be used interchangeably herein. The instructions 166 may be stored in object code format for direct processing by the one or more processors 162, or in any other computer language including scripts or collections of independent source code modules that are interpreted on demand or compiled in advance. Functions, methods and routines of the instructions 166 are explained in more detail below.

FIGS. 5A-5D show another embodiment of an elevator door system 500 that has the door detection system 112 installed. Rather than a sliding hoistway door, the hoistway door 108 in FIGS. 5A-5D is a swinging hoistway door. For systems having a swinging hoistway door 108, contacts 152, 152' may also be used to detect when the elevator car door 104 and/or the hoistway door 108 are closed, as discussed above. In addition, systems with swinging hoistway doors 108 may have an additional pair of contacts (not shown) that detect when the hoistway door 108 is locked. No protrusions are necessary in the elevator door system 500 with swinging hoistway doors since the elevator car door 104 would not be able to push the swinging hoistway door to a closed position.

Figure 5A:
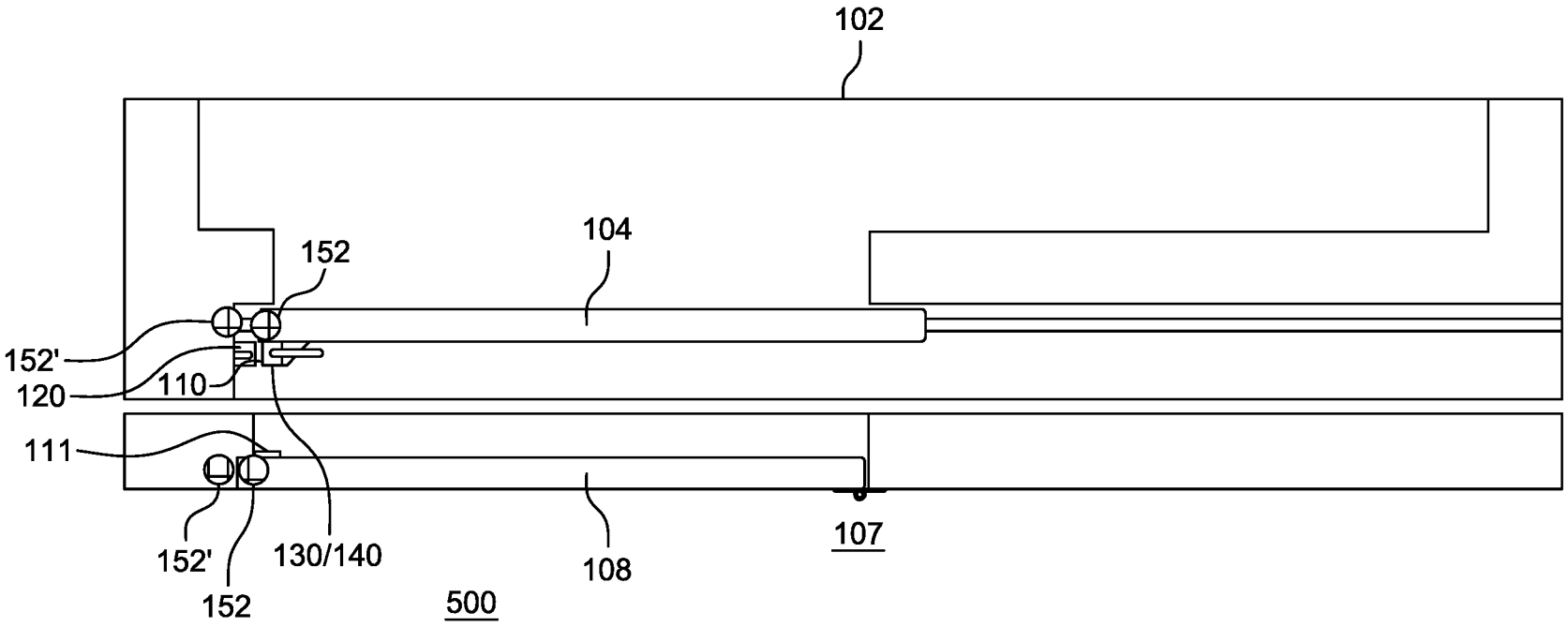
FIG. 5A is a top-down view of an elevator system in accordance with aspects of the disclosure with a detection system in accordance with aspects of the disclosure.
Figure 5B:
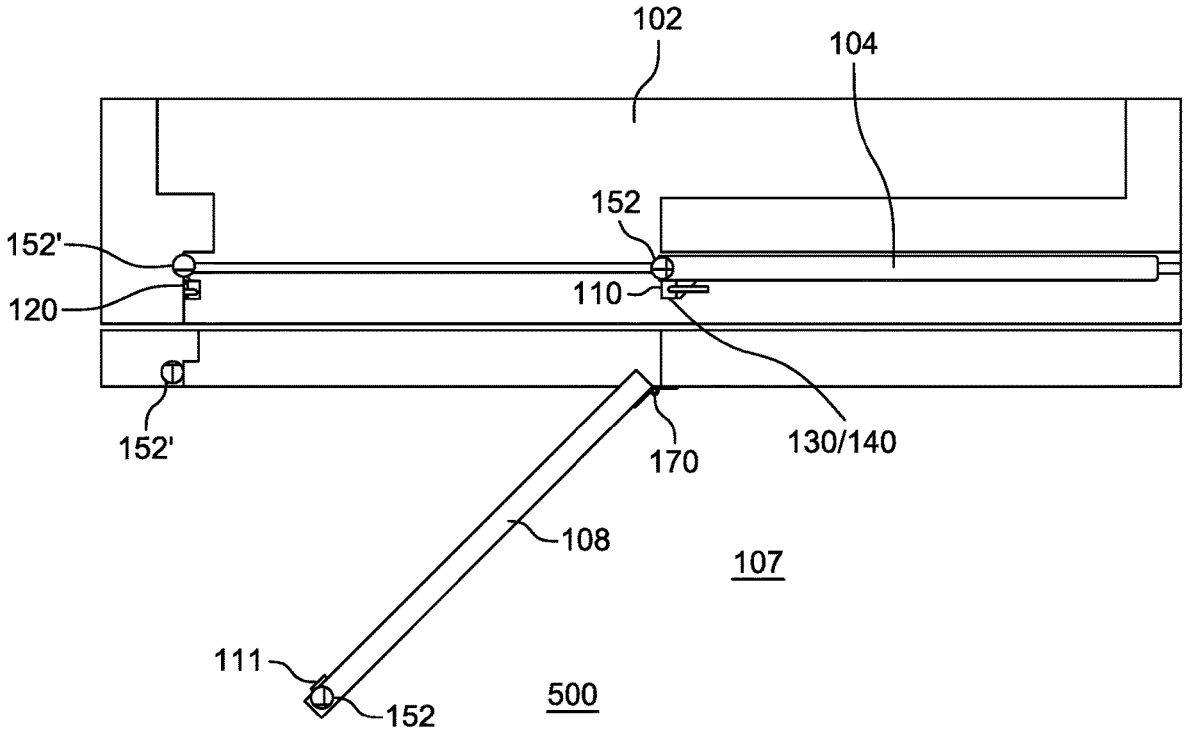
FIG. 5B is another top-down view of the elevator system and detection system of FIG. 5A in accordance with aspects of the disclosure.

As shown in FIG. 5A, in the closed position, the first transmitter-receiver 110, the first receiver 120, the second transmitting face 130, the second receiver 140, and the reflector 111 may be similarly positioned to the elevator detection system 112 shown in FIG. 2A. In an open position, as shown in FIG. 5B, the elevator car door 104 may be positioned (for example, by sliding), relative the first receiver 120, such that the transmitter-receiver 110 is approximately a door's width away from the first receiver 120.

Figure 5C:
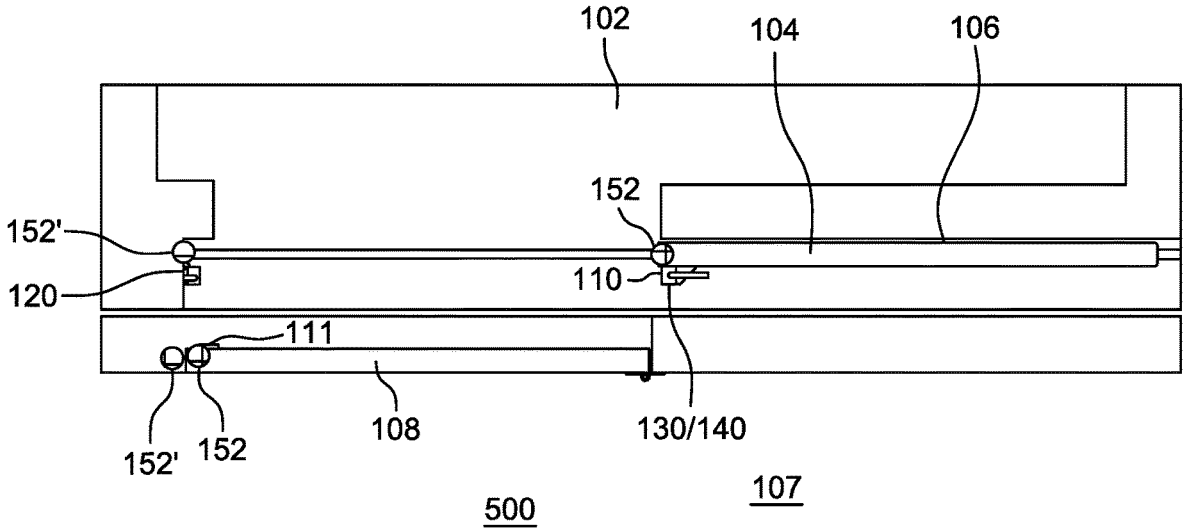
FIG. 5C is a further top-down view of the elevator system and detection system of FIG. 5A in accordance with aspects of the disclosure.
Figure 5D:
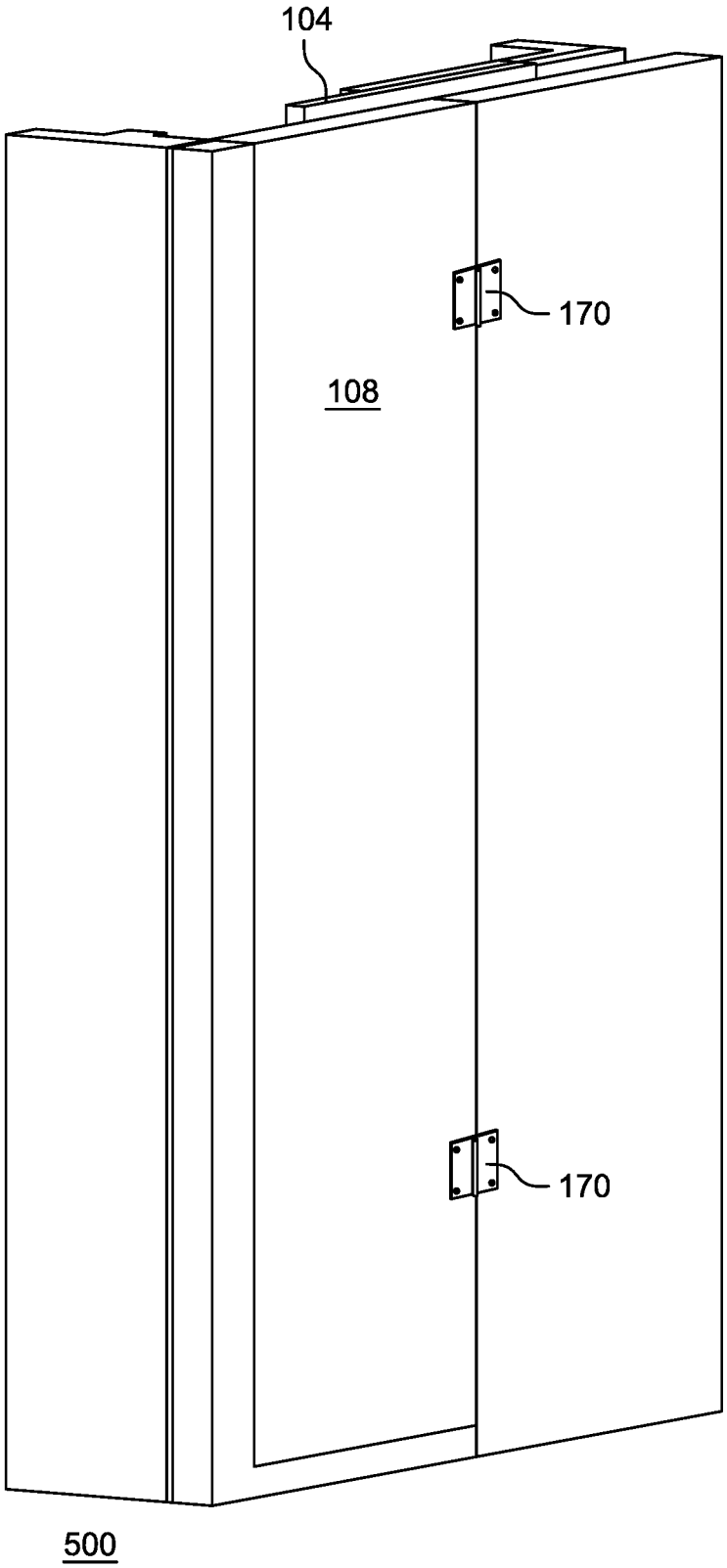
FIG. 5D is a perspective view of the elevator system and detection system of FIG. 5A in accordance with aspects of the disclosure.

The hoistway door 108 may be configured to swing away from the elevator car 102 about a hinge 170. When the hoistway door 108 is in a swung-open position, the reflector 111 does not face the elevator car 102 and does not align with the second transmitting face 130 and second receiver 140. The reflector 111 may remain unaligned with the second transmitting face 130 and second receiver 140 until both the elevator car door 104 and the hoistway door 108 are in a closed position. For example, when the elevator car door 104 is open and the hoistway door 108 is closed, as shown in FIG. 5C, the reflector 111 is not aligned with the second transmitting face 130 or second receiver 140 of the transmitter-receiver 110.

In another embodiment, the elevator door system 100, 200, 300 may have two sliding car doors and two sliding hoistway doors rather than one. The two sliding car doors meet in the middle when in a closed position. Likewise, the two sliding hoistway doors meet in the middle when in the closed position. In this embodiment, first and second car doors may each have transmitter-receivers 110 and first and second hoistway doors may each have reflectors 111. First receivers 120 may be adjacent to or on the first transmitting face 124 of the transmitter-receivers 110, rather than affixed on the door frame. When the car doors and hoistway doors are closed, the second transmitting faces 130 and second receivers 140 are facing and aligned with the reflectors 111. Also when the car doors are closed, and the first receiver of a first car door is facing and aligned with the first transmitting face 124 of a second car door, and vice versa.

In some embodiments, first receiver 120 is on the first car door while the transmitter-receiver 110 is on the second car door. Each of the two car doors may include the second transmitting face 130 and the second receiver 140, and each of the hoistway doors may include the reflector 111. When the car doors and hoistway doors are closed, the first receiver 120 of the first car door is facing and aligned with the transmitter-receiver 110 of the second car door, and the second transmitting face 130 and second receiver 140 of each car door are facing and aligned with the reflector 111 on the corresponding hoistway door.

In yet another embodiment, the transmitter-receiver 110 may include a single transmitter configured to transmit a signal in at least a first direction via the first transmitting face 124 towards the first receiver 120 and a second direction via the second transmitting face 130 away from the elevator car 102 perpendicular to the first direction. In some implementations, the single transmitter may be a three-dimensional transmitter which transmits a light beam having a predetermined angular spread over three dimensions and the first receiver 120 may be a wide field of view receiver, such as described in U.S. Pat. No. 6,167,991 to Full et al. and U.S. Pat. No. 5,886,307 to Full et al., both of which are incorporated by reference herein.

Furthermore, the first receiver 120 may alternatively be positioned adjacent to or on the first transmitting face 124 of the transmitter-receivers 110, similar to how the second receiver 140 may be positioned adjacent to or on the second transmitting face 130. Additionally, one or more second reflectors may be positioned on the elevator door frame 122 facing the first transmitting face 124 of the transmitter-receiver 110 in a manner such that a signal transmitted from the first transmitting face 124 may be reflected off the one or more second reflectors towards the first receiver 120. The first receiver 120 may therefore be configured to receive signals reflected by the second reflector which are transmitted by the transmitter-receiver 110.

In a further embodiment, the transmitter part of transmitter-receiver 110 that is configured to transmit through the first transmitting face 124 may be positioned in the elevator door frame 122 and the first receiver 120 may be positioned on the car door 104 or may be a receiver part of the transmitter-receiver 110.

Figure 6:
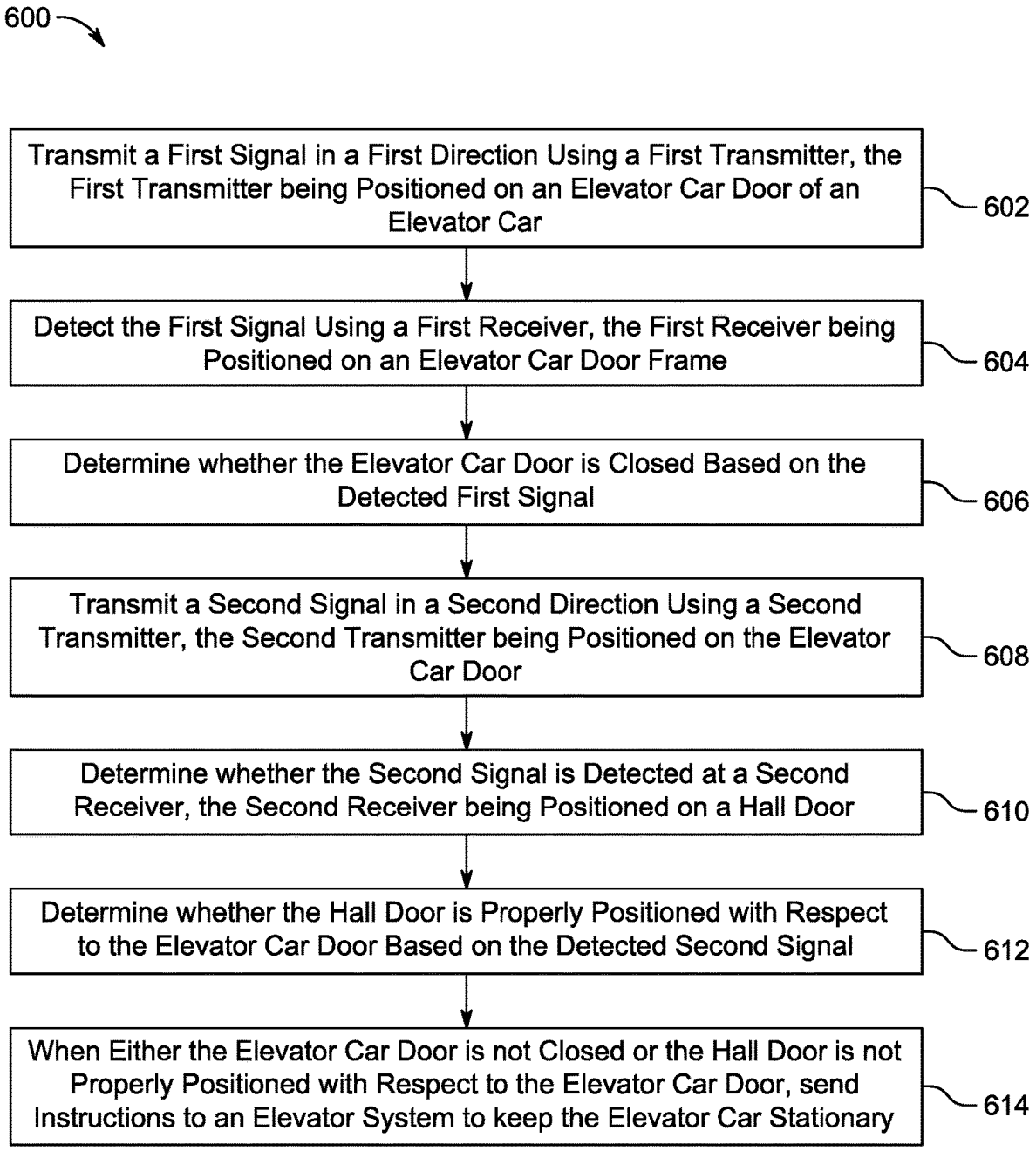
FIG. 6 is a flow diagram of a method in accordance with aspects of the disclosure.

Referring to FIG. 6, flow diagram 600, in accordance with some of the aspects described above, may be performed by the one or more processors 162. While FIG. 6 shows blocks in a particular order, the order may vary and multiple operations may be performed simultaneously. Also, operations may be added or omitted.

At block 602, the one or more processors 162 may transmit a first signal in a first direction using a first transmitter. The first transmitter may be the transmitter-receiver 110 positioned along and near the edge of the elevator car door 104. The first direction may be parallel to the car door 104 and towards a first receiver 120 positioned on the elevator door frame 122. Transmission of the first signal may be continuous or may be modulated at a particular frequency. The first transmitter may be an LED transmitting an infrared light signal.

At block 604, the one or more processors 162 may detect the first signal using the first receiver 120. The one or more processors 162 may detect the first signal based on a frequency of the signal, a frequency of the modulation, or other characteristics of the first signal.

At block 606, the one or more processors 162 may determine whether the elevator car door 104 is closed based on the detected first signal. In one example, the detected first signal has an intensity. When the elevator car door 104 is closed, the intensity of the detected first signal may be at or above the first threshold intensity. When the elevator car door 104 is not closed, the intensity of the detected first signal may be below the first threshold intensity. The one or more processors 162 may therefore determine the intensity of the detected first signal, compare the determined intensity with the first threshold intensity, and determine whether the elevator car door 104 is closed.

At block 608, the one or more processors 162 may transmit a second signal in a second direction using a second transmitter. The second transmitter may be one of the one or more second transmitters 130 positioned on the elevator car door 104 facing away from the elevator car 102. The second direction may be perpendicular to the first direction. Like with the first signal, the second signal may be continuously transmitted or may be modulated at a particular frequency. The second transmitter may also be an LED transmitting an infrared light signal.

At block 610, the one or more processors 162 may determine whether the second signal is detected using the second receiver 140. In addition, the second receiver may be placed in the same or similar location as the second transmitting face 130 and also may be facing the same or similar direction as the second transmitting face 130. The second receiver 140 may therefore receive the second signal after the second signal is reflected by a physical object, such as the hoistway door 108, reflector 111, or reflective material on a surface of the hoistway door 108.

At block 612, the one or more processors 162 may determine whether the hoistway door 108 is properly positioned with respect to the elevator car door 104 based on the detected second signal. In one example, the detected second signal may have an intensity. When the hoistway door 108 is properly positioned with the elevator car door 104, the reflector 111, positioned on the hoistway door 108 facing the elevator car 102, may be positioned directly opposite the second transmitting face 130. When the doors 104, 108 are properly positioned with respect to each other, the second signal transmitted from the second transmitting face 130 may be reflected by the reflector 111 and received at the second receiver 140 at or above the second threshold intensity. When the doors are not properly positioned with respect to each other, the second signal detected at the second receiver 140 may be below the second threshold intensity. The one or more processors 162 may determine the intensity of the detected second signal, compare the intensity of the detected second signal with the second threshold intensity, and determine whether the hoistway door 108 is properly positioned with respect to with the elevator car door 104. In some circumstances, the second signal may not be detected at the second receiver 140, in which case the one or more processors 162 may determine that the hoistway door 108 is not properly positioned with respect to the elevator car door 104.

At block 614, the one or more processors 162 may send instructions to the elevator detection system 112 to keep the elevator car stationary when either the elevator car door 104 is not closed or the hoistway door 108 is not properly positioned with respect to the elevator car door 104. If both the elevator car door 104 is closed and the hoistway door 108 is properly positioned with respect to the elevator car door 104, then both the elevator car door 104 and the hoistway door 108 are in a closed position, and the elevator car 102 may proceed to its next destination. If, however, one of these conditions is not true, then one or both of the doors are not closed, and the elevator car 102 should be held at its current location until at least both doors are closed. The instructions may be for the elevator car 102 to remain stationary until both the elevator car door 104 becomes closed and the hoistway door 108 becomes properly positioned with respect to the elevator car door 104. In addition, the instructions may also include other conditions in which the elevator car 102 may be moved, such as user input is received that indicates that both doors are closed or an override of the instructions to remain stationary. In some implementations, the instructions may also include emitting a sound until both doors are closed or user input is received.

In some embodiments, the door detection system 112 may only comprise the transmitter-receiver 110. The one or more processors 162 may be then configured to determine whether the hoistway door 108 is properly positioned with respect to the elevator door as described above and send instructions to keep the elevator car stationary when the hoistway door 108 is not properly positioned with respect to the elevator door.

In some embodiments, the transmitter-receiver 110 share electrical circuitry and be a transceiver.

The features described above may provide for an elevator system that more reliably ensures that both the elevator car door 104 and the hoistway door 108 are closed before moving the elevator car 102. Elevator rides using the elevator system may therefore be safer and smoother.

Unless otherwise stated, the foregoing embodiments are not mutually exclusive, but may be implemented in various combinations to achieve unique advantages. As these and other variations and combinations of the features discussed above can be utilized without departing from the subject matter defined by the claims, the foregoing description of the embodiments should be taken by way of illustration rather than by way of limitation of the subject matter defined by the claims. In addition, the provision of the examples described herein, as well as clauses phrased as "such as," "including" and the like, should not be interpreted as limiting the subject matter of the claims to the specific examples; rather, the examples are intended to illustrate only one of many possible embodiments. Further, the same reference numbers in different drawings can identify the same or similar elements.

What is claimed is:

1. A door detection system comprising:

an elevator car door that moves towards and away from an elevator door frame;

a hoistway door that moves towards and away from the elevator door frame;

a transmitter-receiver positioned on the elevator car door with a first face configured to transmit a first signal and a second face configured to transmit and receive a second signal;

a first receiver positioned on the elevator door frame configured to receive the first signal; and a reflector positioned on the hoistway door substantially opposite the second face when the elevator car door and the hoistway door are closed;

wherein the transmitter-receiver includes one or more processors configured to:

detect the second signal reflected from the reflector, determine whether the hoistway door is properly positioned with respect to the elevator car door based on the detected second signal, and send instructions to the elevator detection system to keep the elevator car stationary when the hoistway door is open to a different extent than the elevator car door such that the hoistway door is not aligned with respect to the elevator car door.

2. The door detection system of claim 1, wherein the first signal is an infrared light beam.

3. The door detection system of claim 1, wherein the second signal reflected from the reflector is more intense as compared to the second signal reflected from the hoistway door.

4. The door detection system of claim 1, wherein the first face is also configured to receive the first signal reflected from the elevator door frame.

5. The door detection system of claim 1, wherein the one or more processors determine the intensity of the detected second signal reflected from the reflector and compare the detected second signal to a preset threshold intensity to determine whether the elevator car door is closed.

6. The door detection system of claim 1, wherein the first signal is transmitted in a direction parallel with the elevator car.

7. The door detection system of claim 1, wherein the second signal is transmitted in a direction perpendicular to the elevator car.

8. The door detection system of claim 1, wherein the first signal is transmitted in a direction parallel with the elevator car and the second signal is transmitted in a direction perpendicular to the elevator car.

9. The door detection system of claim 1, wherein the hoistway door is a swinging hoistway door that swings away from the elevator car door about a hinge.

10. A door detection system comprising:

a first pair of contacts configured to indicate when an elevator car door of an elevator car is closed;

a second pair of contacts configured to indicate when a hoistway door is closed;

a transmitter positioned on the elevator car door configured to transmit a signal in a direction perpendicular to the elevator car door;

a reflector positioned on the hoistway door substantially opposite the transmitter when the elevator car door and the hoistway door are closed;

a receiver configured to receive the signal reflected from the reflector; and one or more processors configured to:

detect the signal reflected from the reflector using the receiver, determine whether the hoistway door is aligned with respect to the elevator car door based on the signal, and send instructions to keep the elevator car stationary when the hoistway door is open to a different extent than the elevator car door such that the hoistway door is not aligned with respect to the elevator car door.

11. The door detection system of claim 10, wherein the elevator car door includes a first protrusion and the hoistway door includes a second protrusion, and wherein the elevator door protrusion contacts the hoistway door protrusion to close the hoistway door.

12. The door detection system of claim 10, wherein the hoistway door is a swinging hoistway door that swings away from the elevator car door about a hinge.

13. A door detection system comprising:

one or more first transmitters positioned on an elevator car door of an elevator car, the one or more first transmitters facing in a first direction parallel to the elevator car door and being configured to transmit a first signal;

one or more first receivers positioned on an elevator car door frame of the elevator car substantially opposite the one or more first transmitters;

one or more second transmitters positioned on the elevator car door, the one or more second transmitters facing in a second direction perpendicular to the first direction and being configured to transmit a second signal;

one or more second receivers positioned on the elevator car door facing in the second direction;

a reflector positioned on a hoistway door substantially opposite to the one or more second transmitters and the one or more second receivers, when the elevator car door and the hoistway door are closed; and one or more processors configured to:

detect the first signal using the one or more first receivers, determine whether the elevator car door is closed based on the detected first signal, detect the second signal using the one or more second receivers, determine whether the hoistway door is aligned with respect to the elevator door in the second direction based on the detected second signal, and send instructions to an elevator system to keep the elevator car stationary when either the elevator car door is not closed or the hoistway door is not aligned with respect to the elevator car door in the second direction.

* * * * *